US007945194B2

(12) United States Patent
Yamada et al.

(10) Patent No.: US 7,945,194 B2
(45) Date of Patent: May 17, 2011

(54) IMAGE FORMING APPARATUS AND IMAGE FORMING SYSTEM REDUCING ELECTRICAL DISCHARGE

(75) Inventors: Yoichi Yamada, Shiojiri (JP); Hiroshi Kato, Okaya (JP); Tomohiro Aruga, Shiojiri (JP); Takatomo Fukumoto, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 460 days.

(21) Appl. No.: 12/121,627

(22) Filed: May 15, 2008

(65) Prior Publication Data

US 2008/0298851 A1 Dec. 4, 2008

(30) Foreign Application Priority Data

May 30, 2007 (JP) ..... 2007-144064

(51) Int. Cl.
*G03G 15/08* (2006.01)

(52) U.S. Cl. ..... 399/279

(58) Field of Classification Search ..... 399/279, 399/273, 283, 286
See application file for complete search history.

(56) References Cited

U.S. PATENT DOCUMENTS

| | | | | |
|---|---|---|---|---|
| 4,780,741 | A * | 10/1988 | Wada et al. | 399/274 |
| 5,930,570 | A * | 7/1999 | Saito et al. | 399/279 |
| 6,183,927 | B1 * | 2/2001 | Magome et al. | 430/108.3 |
| 2006/0056880 | A1 * | 3/2006 | Okamoto | 399/284 |
| 2007/0110481 | A1 * | 5/2007 | Yamada et al. | 399/279 |
| 2008/0292367 | A1 * | 11/2008 | Yamazaki et al. | 399/286 |

FOREIGN PATENT DOCUMENTS

| | | |
|---|---|---|
| JP | 05-273782 | 10/1993 |
| JP | 08-248767 | 9/1996 |
| JP | 2003-057940 | 2/2003 |
| JP | 2006-259384 | 9/2006 |
| JP | 2006-301481 | 11/2006 |
| JP | 2007-121950 | 5/2007 |

OTHER PUBLICATIONS

Machine translation of Yamada et al. (JP 2007-121,950) Pub date May 17, 2007, Listed in IDS.*

* cited by examiner

*Primary Examiner* — David M Gray
*Assistant Examiner* — Rodney Bonnette
(74) *Attorney, Agent, or Firm* — DLA Piper LLP (US)

(57) ABSTRACT

An image formation apparatus includes an image carrier and a toner carrier having a concave portion arrayed in a regular pattern on its surface. A latent image that is carried on the image carrier is developed by toner carried in the concave portion by applying a development voltage to the toner carrier. After the toner carrier has developed the latent image, at least one layer of toner remains in the concave portion.

5 Claims, 16 Drawing Sheets

IMAGE FORMING APPARATUS AND IMAGE FORMING SYSTEM REDUCING ELECTRICAL DISCHARGE

BACKGROUND

1. Technical Field

The present invention relates to an image formation apparatus and an image formation system.

2. Related Art

An image formation apparatus such as a laser beam printer or the like is generally known in the art. The image formation apparatus of the related art is provided with, as a typical example of the configuration thereof, an image carrier that carries a latent image, a toner carrier that carries toner and develops the latent image that is carried on the image carrier by means of the toner, and a voltage application unit that applies a development voltage to the toner carrier for the purpose of the development of the latent image. The related-art image formation apparatus having the configuration described above operates roughly as follows. Upon the reception of an image signal or other kind of transmission signal from an external device such as a computer or the like, the toner carrier, to which a development voltage is applied by the voltage application unit, develops a latent image carried on the image carrier. By this means, a toner image is formed on the image carrier. Then, the related-art image formation apparatus transfers the formed toner image onto an image-formation target medium so as to form a final image thereon.

In the technical field to which the present invention pertains, some toner carriers have concave portions, that is, recesses or concavities, that are arrayed in a regular pattern. These regular concave portions are formed so that the toner carrier can carry a sufficient amount of toner on the surface thereof, which constitutes the main reason of the formation of these regular concave portions among other technical considerations. Although the plural form thereof is used here to refer to the recesses or concavities, it may be safely expressed as a concave portion. In the configuration of the toner carrier of the related art having the above-described regularly recessed surface, the concave portions function as a main region that carries toner. A few examples of the related-art image formation apparatus having such a configuration are described in JP-A-2006-259384 and JP-A-2003-57940.

Before the development of a latent image, toner that is carried by the toner carrier covers these concave portions, which means that these concave portions are not exposed. On the other hand, immediately after the completion of development of a latent image that is carried by the image carrier by means of toner that is carried mainly in the concave portions formed in the surface of the toner carrier, there is a possibility that (some of) the concave portions become exposed because the toner may not cover them immediately after the completion of development thereof. Or, in other words, in some cases, the concave portions might become exposed immediately after the movement of the toner, which was carried mainly in the concave portions, onto the image carrier. If the voltage application unit continues the application of a development voltage to the toner carrier even under the conditions that the concave portions thereof have become exposed, there is an adverse possibility that electric discharge occurs between the exposed concave portions thereof and the image carrier due to the continuously applied development voltage.

SUMMARY

An advantage of some aspects of the invention is to prevent the occurrence of electric discharge between an image carrier and a concave portion formed on the surface of a toner carrier immediately after the completion of development.

In order to address the above-identified problem without any limitation thereto, the invention provides, as the essence thereof, an image formation apparatus that includes: an image carrier that carries a latent image; a toner carrier that has, on a surface of the toner carrier, a concave portion arrayed in a regular pattern so as to carry toner, and develops the latent image that is carried on the image carrier by means of the toner carried in the concave portion; and a voltage application section that applies a development voltage to the toner carrier for the purpose of the development of the latent image, wherein, immediately after that the toner carrier has developed the latent image, which is carried on the image carrier, by means of the toner carried in the concave portion in response to the application of the development bias to the toner carrier by the voltage application section, at least one layer of the toner remains carried in the concave portion.

Other features and advantages offered by the invention will be fully understood by referring to the following detailed description in conjunction with the accompanying drawings.

Referring to the following detailed description in conjunction with the accompanying drawings, one will fully understand at least the following inventive concept of the invention.

As a first aspect thereof, the invention provides an image formation apparatus that includes: an image carrier that carries a latent image; a toner carrier that has, on a surface of the toner carrier, a concave portion arrayed in a regular pattern so as to carry toner, and develops the latent image that is carried on the image carrier by means of the toner carried in the concave portion; and a voltage application section that applies a development voltage to the toner carrier for the purpose of the development of the latent image, wherein, immediately after that the toner carrier has developed the latent image, which is carried on the image carrier, by means of the toner carried in the concave portion in response to the application of the development bias to the toner carrier by the voltage application section, at least one layer of the toner remains carried in the concave portion. With the above-described configuration of an image formation apparatus according to the first aspect of the invention, it is possible to prevent the occurrence of electric discharge between an image carrier and a concave portion formed on the surface of a toner carrier immediately after the completion of development.

It is preferable that the image formation apparatus according to the first aspect of the invention should further include a layer-thickness controlling member that contacts the surface of the toner carrier so as to control the layer thickness of the toner that is carried on the surface of the toner carrier, wherein the depth of the concave portion is smaller than the volume mean particle diameter of the toner multiplied by three. With the preferred configuration of an image formation apparatus described above, it is possible to electrify the toner that is carried in the concave portion to adequate and sufficient amount of electrification.

In the configuration of the image formation apparatus according to the first aspect of the invention described above, it is preferable that the concave portion should be formed as the bottom of two different spiral-pattern groove regions one of which is formed to have an angle of gradient viewed with respect to the circumferential direction of the toner carrier that differs from another angle of gradient viewed with respect to the circumferential direction of the toner carrier of the other thereof; and these two different spiral-pattern groove regions should intersect with each other, thereby forming a grid pattern. With the preferred configuration of an image formation apparatus described above, it is possible to form the concave portion that is arrayed in a regular pattern in an easy manner.

It is preferable that the image formation apparatus having a preferred configuration described above should further include a removing member that has a contact region made of a porous foam material, the contact region of the removing member contacting the surface of the toner carrier so as to remove the toner from the surface of the toner carrier after the development of the latent image carried on the image carrier, wherein the toner carrier has, on the surface thereof, a plurality of non-concave portions that are arrayed in a regular pattern, each of the plurality of non-concave portions having a convex portion and further having side portions that go down from the convex portion to the concave portion, the concave portion surrounding each of the plurality of non-concave portions; and the maximum value of the distance between one convex portion and another convex portion adjacent thereto among the plurality of convex portions is smaller than the average distance between one pore of the contact region and another pore thereof adjacent thereto With the preferred configuration of an image formation apparatus described above, it is possible to facilitate that at least one layer of toner remains carried in the concave portion immediately after the completion of development.

It is preferable that the image formation apparatus having a preferred configuration described above should further include a removing member that has a contact region made of a porous foam material, the contact region of the removing member contacting the surface of the toner carrier so as to remove the toner from the surface of the toner carrier after the development of the latent image carried on the image carrier, wherein the toner carrier has, on the surface thereof, a plurality of non-concave portions that are arrayed in a regular pattern, each of the plurality of non-concave portions having a convex portion and further having side portions that go down from the convex portion to the concave portion, the concave portion surrounding each of the plurality of non-concave portions; and the maximum value of the widths of the non-concave portions is larger than the average opening width of the pores of the contact region of the removing member, or alternatively, the maximum value of the heights of the non-concave portions that is measured from the concave portion is larger than the average opening depth of the pores. With the preferred configuration of an image formation apparatus described above, it is possible to facilitate that at least one layer of toner remains carried in the concave portion immediately after the completion of development.

In the configuration of the image formation apparatus according to the first aspect of the invention described above, it is preferable that the moving speed of the surface of the toner carrier measured at the time of the rotation thereof should be greater than that of the image carrier measured at the time of the rotation thereof. With the preferred configuration of an image formation apparatus described above, it is possible to avoid any shortage (i.e., insufficiency) in the amount of toner that is used for developing a latent image.

As a second aspect thereof, the invention provides an image formation system that has: a computer; and an image formation apparatus that can be connected to the computer, the image formation apparatus of the image formation system including: an image carrier that carries a latent image; a toner carrier that has, on a surface of the toner carrier, a concave portion arrayed in a regular pattern so as to carry toner, and develops the latent image that is carried on the image carrier by means of the toner carried in the concave portion; and a voltage application section that applies a development voltage to the toner carrier for the purpose of the development of the latent image, wherein, immediately after that the toner carrier has developed the latent image, which is carried on the image carrier, by means of the toner carried in the concave portion in response to the application of the development bias to the toner carrier by the voltage application section, at least one layer of the toner remains carried in the concave portion. With the above-described configuration of an image formation system according to the second aspect of the invention, it is possible to prevent the occurrence of electric discharge between an image carrier and a concave portion formed on the surface of a toner carrier immediately after the completion of development.

BRIEF DESCRIPTION OF THE DRAWINGS

The invention will be described with reference to the accompanying drawings, wherein like numbers reference like elements.

FIG. 7B illustrates a sectional view taken along the line VIIB-VIIB of FIG. 7A.

FIG. 15A illustrates the state of the concave portion 515 before it reaches the development position, whereas FIG. 15B illustrates the state of the concave portion 515 after it has passed through the development position.

DESCRIPTION OF EXEMPLARY EMBODIMENTS

Example of General Configuration of Image Formation Apparatus

Figure 1:
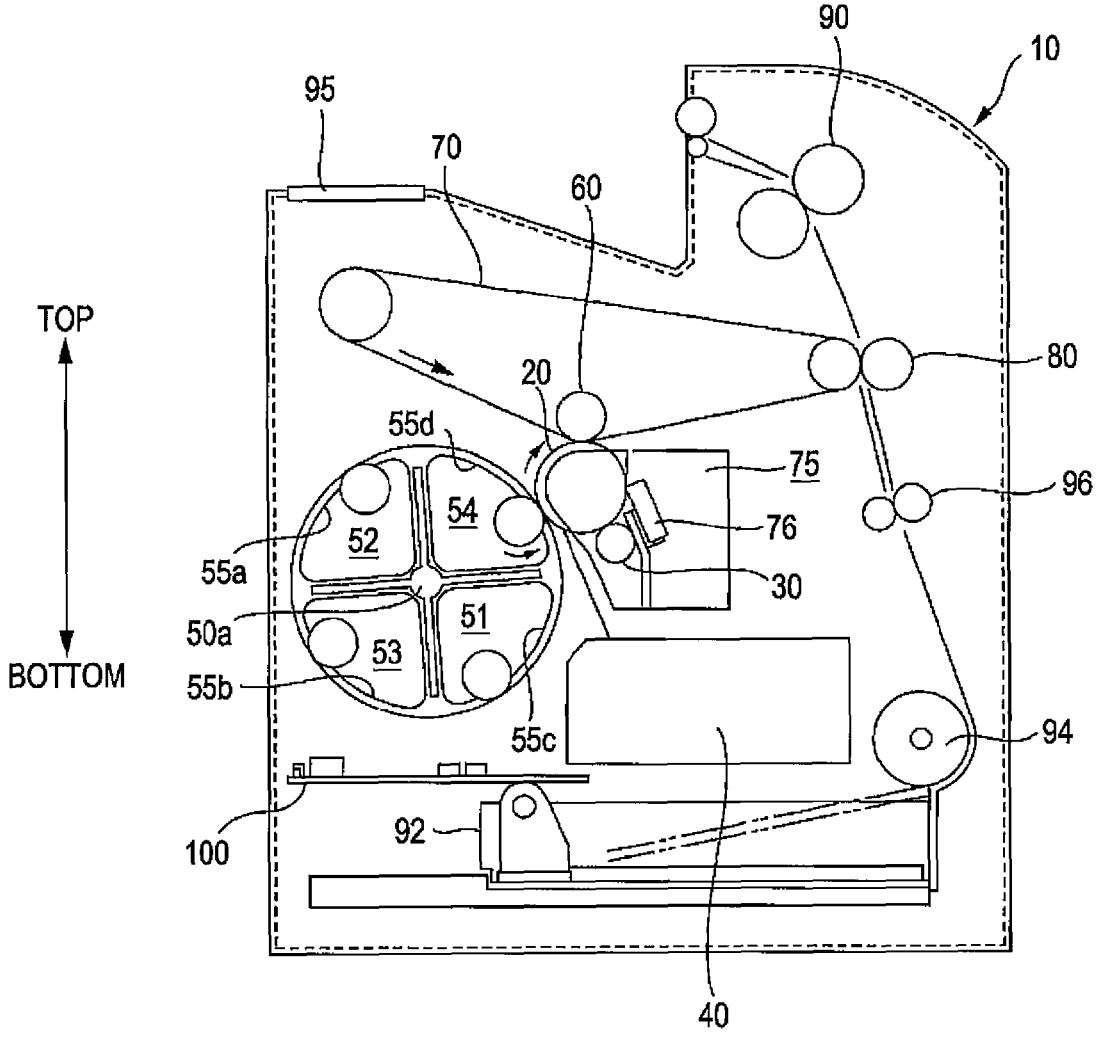
FIG. 1 is a diagram that schematically illustrates an example of the main components of a printer 10 according to an exemplary embodiment of the invention.

In the following description, an example of the general configuration of a laser beam printer 10, which constitutes a non-limiting example of an "image formation apparatus" according to the invention, is explained below with reference to FIG. 1. The laser beam printer 10 may be hereafter simply referred to as a "printer" 10. FIG. 1 is a diagram that schematically illustrates an example of the main components of the printer 10 according to an exemplary embodiment of the invention. It should be noted that the double-headed arrow shown in FIG. 1 indicates the vertical orientation of the printer 10. For example, a paper-feed tray 92 is provided at the lower/bottom portion of the printer 10. An image fixation unit 90 is provided at the upper/top portion thereof.

As illustrated in FIG. 1, the printer 10 according to the present embodiment of the invention is provided with a photosensitive member 20, which constitutes a non-limiting example of an "image carrier" according to the invention. In addition to the photosensitive member 20, the printer 10 according to the present embodiment of the invention is further provided with an electrostatic charging unit 30, a light exposure unit 40, a YMCK rotary developing unit 50, a primary image-transfer unit 60, an intermediary image-transfer unit 70, and a cleaning unit 75, which are provided around the photosensitive member 20. Specifically, these components are arranged in the order of appearance herein toward the downward region of the photosensitive member 20, which is viewed along the rotational direction thereof. Moreover, the printer 10 according to the present embodiment of the invention is further provided with a secondary image-transfer unit 80, the image fixation unit 90, a display unit 95, and a control unit 100. The display unit 95 is made of a liquid crystal panel or the like. The display panel 95 serves as notification means for providing status and/or other information to users. The control unit 100 controls these functional component units without any limitation thereto. The control unit 100 is responsible for controlling the operations of the printer 10 as a whole.

The photosensitive member 20 has a cylindrical conductive base substrate. In addition, the photosensitive member 20 has a photosensitive layer formed on the outer circumferential surface of the cylindrical conductive base substrate. In the configuration of the printer 10 according to the present embodiment of the invention, the photosensitive member 20 can rotate clockwise around its turn axis during operation, that is, in the direction shown by an arrow in FIG. 1. The electrostatic charging unit 30 is a device that electrifies the photosensitive member 20. The light exposure unit 40 is a device that forms a latent image on the electrified photosensitive member 20 by irradiating a laser beam thereon. The light exposure unit 40 is provided with a semiconductor laser, a polygon mirror, an F-θ lens, and the like. On the basis of an image signal that is inputted from a host computer, the light exposure unit 40 irradiates a modulated laser beam onto the electrostatic-charged photosensitive member 20. A few examples of the host computer are, without any intention to limit thereto, a personal computer or a word processor. Note that the host computer is not illustrated in the drawing.

The YMCK rotary developing unit 50 is a device that develops a latent image formed on the photosensitive member 20 by means of toner T that is contained in each development apparatus provided for the corresponding one of Y, M, C, and K color components. Specifically, the YMCK rotary developing unit 50 develops a latent image formed on the photosensitive member 20 by means of a black (K) toner that is contained in a black development apparatus 51, whereas the YMCK rotary developing unit 50 develops the latent image formed on the photosensitive member 20 by means of a magenta (M) toner that is contained in a magenta development apparatus 52. In like manner, the YMCK rotary developing unit 50 develops the latent image formed on the photosensitive member 20 by means of a cyan (C) toner that is contained in a cyan development apparatus 53, whereas the YMCK rotary developing unit 50 develops the latent image formed on the photosensitive member 20 by means of a yellow (Y) toner that is contained in a yellow development apparatus 54.

The YMCK rotary developing unit 50 is configured so that it can rotate with these black development apparatus 51, magenta development apparatus 52, cyan development apparatus 53, and yellow development apparatus 54 being mounted therein. As the YMCK rotary developing unit 50 turns, the respective positions of these black development apparatus 51, magenta development apparatus 52, cyan development apparatus 53, and yellow development apparatus 54 are moved in a rotational direction. More specifically, the YMCK rotary developing unit 50 has four developing-apparatus holders (i.e., holding portions) 55*a*, 55*b*, 55*c*, and 55*d* to which the above-mentioned four development apparatuses 52, 53, 51, and 54 are fixedly attached, respectively. Having such a configuration, the YMCK rotary developing unit 50 can turn around its center axis 50*a* so as to move the respective absolute positions of the above-mentioned four development apparatuses 51, 52, 53, and 54 while maintaining the relative positions thereof with respect to one another. At each time when the formation of an image for one page has been completed, the YMCK rotary developing unit 50 operates in a rotational direction so as to move the respective absolute positions of these four development apparatuses 51, 52, 53, and 54 in such a manner that each of these four development apparatuses 51, 52, 53, and 54 faces, in its turn, the photosensitive member 20 in a sequential order. At each time when "currently selected" one of these four development apparatuses 51, 52, 53, and 54 faces the photosensitive member 20, the YMCK rotary developing unit 50 develops a latent image formed on the photosensitive member 20 by means of the toner T that is contained in the above-mentioned currently-selected one of these four development apparatus 51, 52, 53, and 54, thereby performing sequential development thereon. Each of these black development apparatus 51, magenta development apparatus 52, cyan development apparatus 53, and yellow development apparatus 54 can be detachably attached to the corresponding one of the above-mentioned four developing-apparatus holding portions (55*c*, 55*a*, 55*b*, and 55*d*) of the YMCK rotary developing unit 50. A more detailed explanation of these four development apparatuses 51, 52, 53, and 54 will be given later.

The primary image-transfer unit 60 is a device that transfers each single-color toner image formed on the photosensitive member 20 onto the intermediary image-transfer unit 70. Four toner colors of images, that is, a yellow toner image, a magenta toner image, a cyan toner image, and a black toner image, are sequentially transferred onto the intermediary image-transfer unit 70 in a superposed manner, that is, one over another so as to form a full-color toner image thereon. The intermediary image-transfer unit 70 is a laminated endless belt, where the lamination thereof is formed as follows. A tin-deposition layer, that is, an over-layer made of tin, is formed on the surface of a PET film. Then, a semi-conductive coating is applied onto the surface of the tin-deposition layer formed on the surface of the PET film. Having such a lamination structure, the intermediary image-transfer unit 70 is driven to rotate at substantially the same circumferential velocity, that is, at substantially the same peripheral velocity, as that of the photosensitive member 20. The secondary image-transfer unit 80 is a device that transfers a single-color toner image or a full-color toner image that is formed on the intermediary image-transfer unit (i.e., intermediary image-transfer belt) 70 onto a sheet of print target paper, film, cloth, or any other kind of print target medium. The image fixation unit 90 is a device that applies heat and pressure onto a single-color toner image or a full-color toner image that is transferred to a print target medium so as to form an indelible image thereon.

The cleaning unit 75 has a cleaning blade 76 made of rubber that is provided between the primary image-transfer unit 60 and the electrostatic charging unit 30. The rubber-made cleaning blade 76 of the cleaning unit 75 is in press-contact with the surface of the photosensitive member 20. After the transferring of a toner image formed on the photosensitive member 20 onto the intermediary image-transfer unit 70, which is performed by the primary image-transfer unit 60, the cleaning blade 76 of the cleaning unit 75 scrapes any remaining toner T off the surface of the photosensitive member 20.

Figure 2:
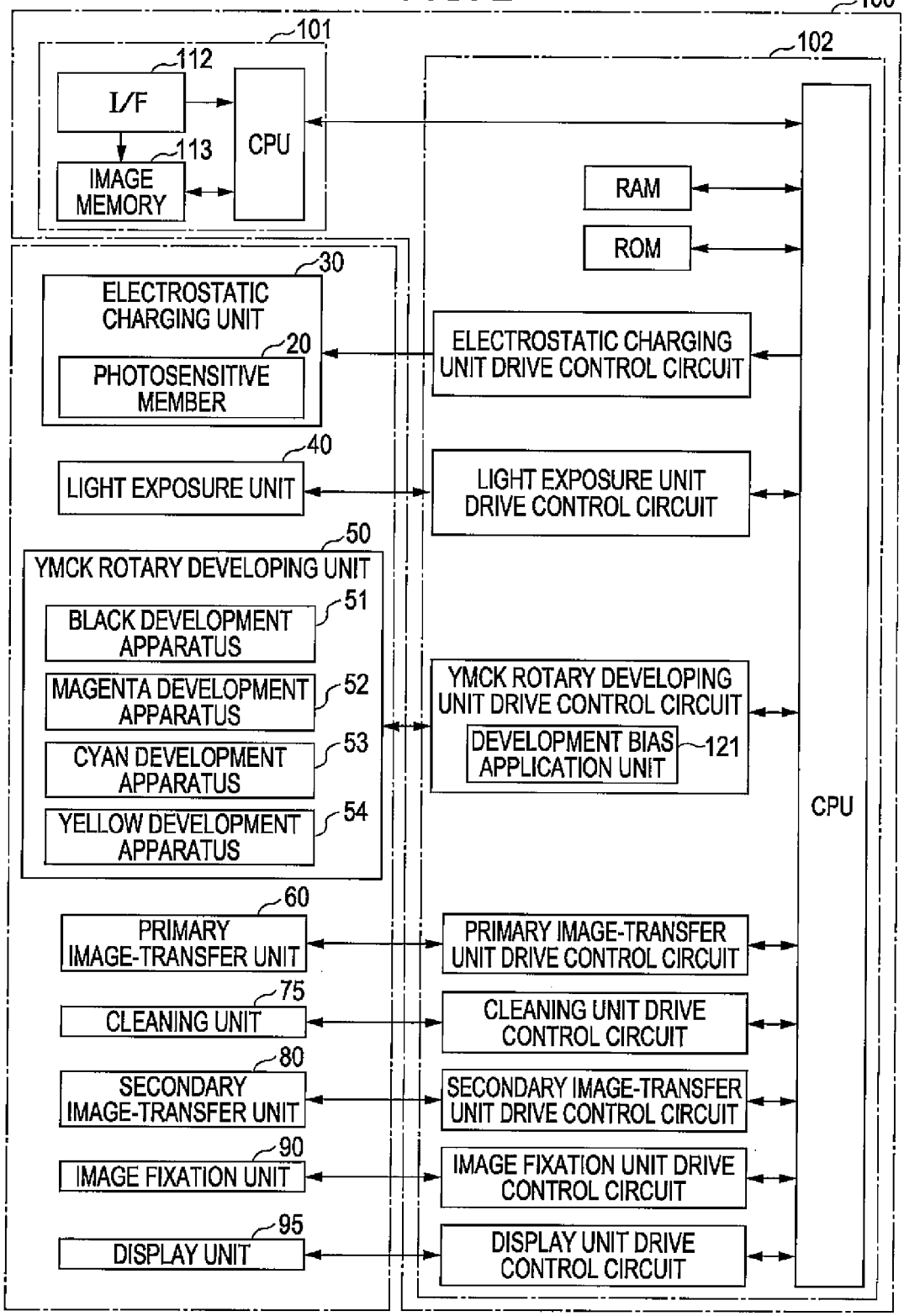
FIG. 2 is a block diagram that illustrates an example of the configuration of the control unit of the printer 10 illustrated in FIG. 1.

As illustrated in FIG. 2, the control unit 100 is made up of a main controller 101 and a unit controller 102. An image signal and a control signal are inputted into the main controller 101. The unit controller 102 controls each of the aforementioned functional units and components in response to instructions issued on the basis of the image signal and the control signal so as to form an image.

Next, the operation of the printer 10 having the above-described configuration is explained below. As a first step, an image signal and a control signal are inputted from the aforementioned host computer, which is not illustrated in the accompanying drawings, into the main controller 101 of the printer 10 via the interface (hereafter may be abbreviated as "I/F") 112 thereof. Then, in response to a command issued from the main controller 101, the photosensitive member 20 and the intermediary image-transfer unit 70 rotate under the control of the unit controller 102. As the photosensitive member 20 rotates, the electrification-target region thereof reaches its electrification position. Then, the electrification unit (i.e., electrostatic charging unit) 30 electrifies the photosensitive member 20 at the electrification position in a sequential manner.

As the photosensitive member 20 further rotates, the electrified region thereof reaches its light exposure position. Then, at the light exposure region, the light exposure unit 40 forms a latent image that corresponds to image information on a first color, for example, image information on yellow Y, at the electrified region thereof. On the other hand, the yellow development apparatus 54 of the YMCK rotary developing unit 50, which contains the yellow (Y) toner, is set at a development position. The development position is a location at which, in this example, the yellow development apparatus 54 faces the photosensitive member 20.

As the photosensitive member 20 further rotates, the latent image formed thereon reaches its development position. Then, at the development position, the yellow development apparatus 54 develops (i.e., visualizes) the latent image formed on the photosensitive member 20 by means of the yellow toner. In this way, a yellow toner image is formed on the photosensitive member 20. As the photosensitive member 20 further rotates, the yellow toner image that is formed on the photosensitive member 20 reaches its primary image-transfer position. Then, at the primary image-transfer position, the primary image-transfer unit 60 transfers the yellow toner image formed on the photosensitive member 20 onto the intermediary image-transfer unit 70. In the primary image-transfer process described above, a primary image-transfer voltage is applied to the primary image-transfer unit 60. The primary image-transfer voltage has a polarity that is opposite to the electrification polarity of the toner T. During the execution of the primary image transfer described above, the photosensitive member 20 is in contact with the intermediary image-transfer unit 70, whereas the secondary image-transfer unit 80 is not in contact with the intermediary image-transfer unit 70.

The development apparatuses corresponding to remaining color components perform the same series of operations as that described above for the second, third, and fourth color components in a sequential manner. By this means, four-color toner images corresponding to respective image signals are transferred onto the intermediary image-transfer unit 70 in a superposed (i.e., overlapping) manner. As a result thereof, a full-color toner image is formed on the intermediary image-transfer unit 70.

As the intermediary image-transfer belt (i.e., intermediary image-transfer unit) 70 moves in a rotational manner, the full-color toner image that is formed on the intermediary image-transfer unit 70 reaches a secondary image-transfer position. Then, at the secondary image-transfer position, the secondary image-transfer unit 80 transfers the full-color toner image that has been formed on the intermediary image-transfer unit 70 onto an image-transfer target medium (i.e., print target medium). The image-transfer target medium is picked up from the aforementioned paper-feed tray 92. The picked-up image-transfer target medium is then transported through the operation of a paper-feed roller 94 and a registration roller 96 to reach the secondary image-transfer unit 80. During the execution of the secondary image transfer described above, the secondary image-transfer unit 80 is pressed against the intermediary image-transfer unit 70. At the same time, a secondary image-transfer voltage is applied to the secondary image-transfer unit 80. Thereafter, the print target medium onto which the full-color toner image has been transferred in the secondary image-transfer process is transported to the image fixation unit 90. Then, the image fixation unit 90 applies heat and pressure onto the full-color toner image transferred onto the print target medium for the purpose of image fixation.

After having passed through the primary image-transfer position, the toner T that is adhered to the surface of the photosensitive member 20 is scraped away by the cleaning blade 76, which is supported by the cleaning unit 75. The removal of the remaining toner T from the surface of the photosensitive member 20 makes it ready for the next electrification that is performed so as to form another (i.e., next) latent image thereon. The scraped-off toner T is then collected into a residue-toner collecting container of the cleaning unit 75.

Exemplary Configuration of Control Unit

Next, with reference to FIG. 2, an exemplary configuration of the control unit 100 is explained below. The main controller 101 of the control unit 100 is electrically connected to the aforementioned host computer via the I/F 112 thereof. The main controller 101 has an image memory 113. The image memory 113 of the main controller 101 stores an image signal that is inputted from the host computer. The unit controller 102 is electrically connected to each of the above-mentioned functional units of the printer 10, or more specifically, electrically connected to the electrostatic charging unit 30, the light exposure unit 40, the YMCK rotary developing unit 50, the primary image-transfer unit 60, the intermediary image-transfer unit 70, the cleaning unit 75, the secondary image-transfer unit 80, the image fixation unit 90, and the display unit 95. On the basis of a signal that is inputted from the main controller 101, the unit controller 102 controls these functional units while detecting the state thereof upon reception of a signal from a sensor that is provided on each thereof.

Example of Configuration of Development Apparatus

Figure 3:
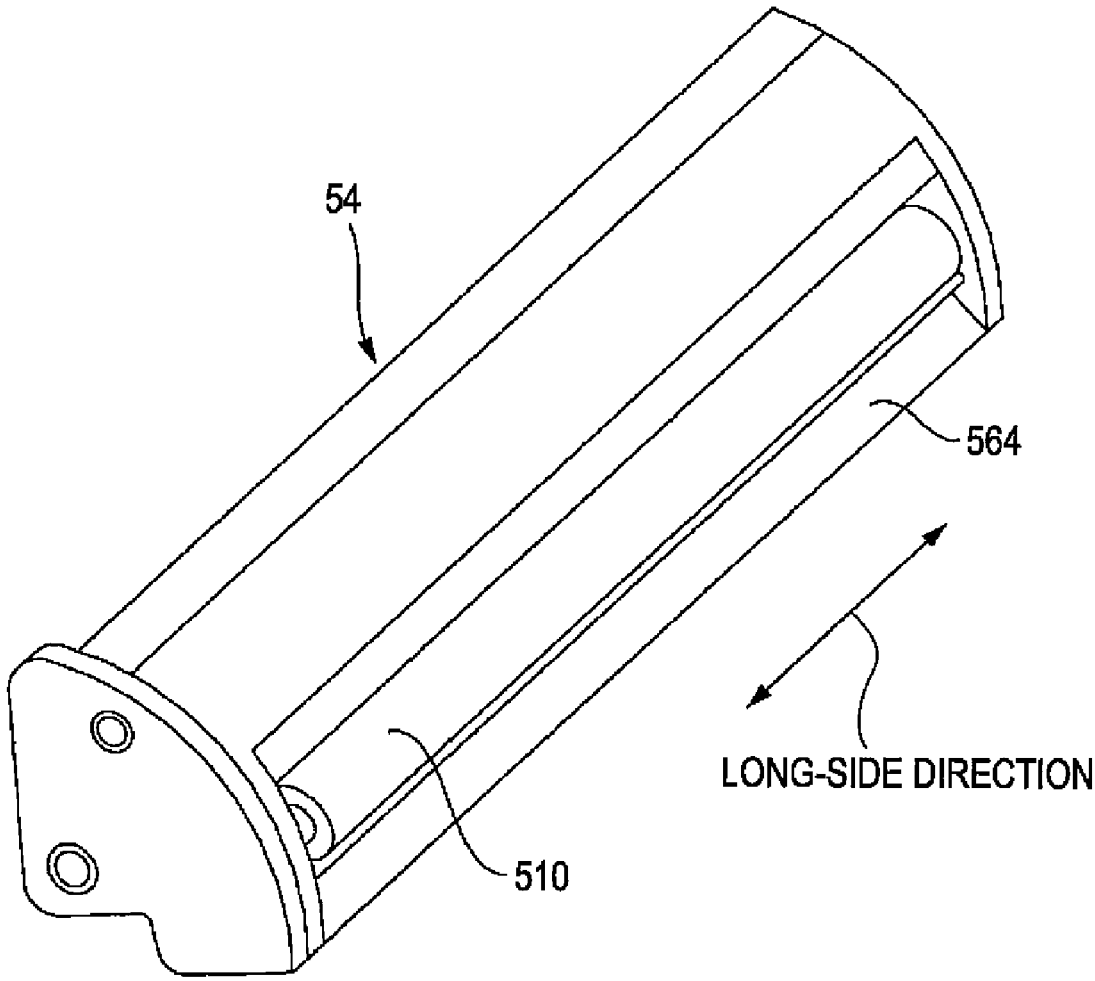
FIG. 3 is a perspective view that schematically illustrates an example of the configuration of a development apparatus according to an exemplary embodiment of the invention.
Figure 4:
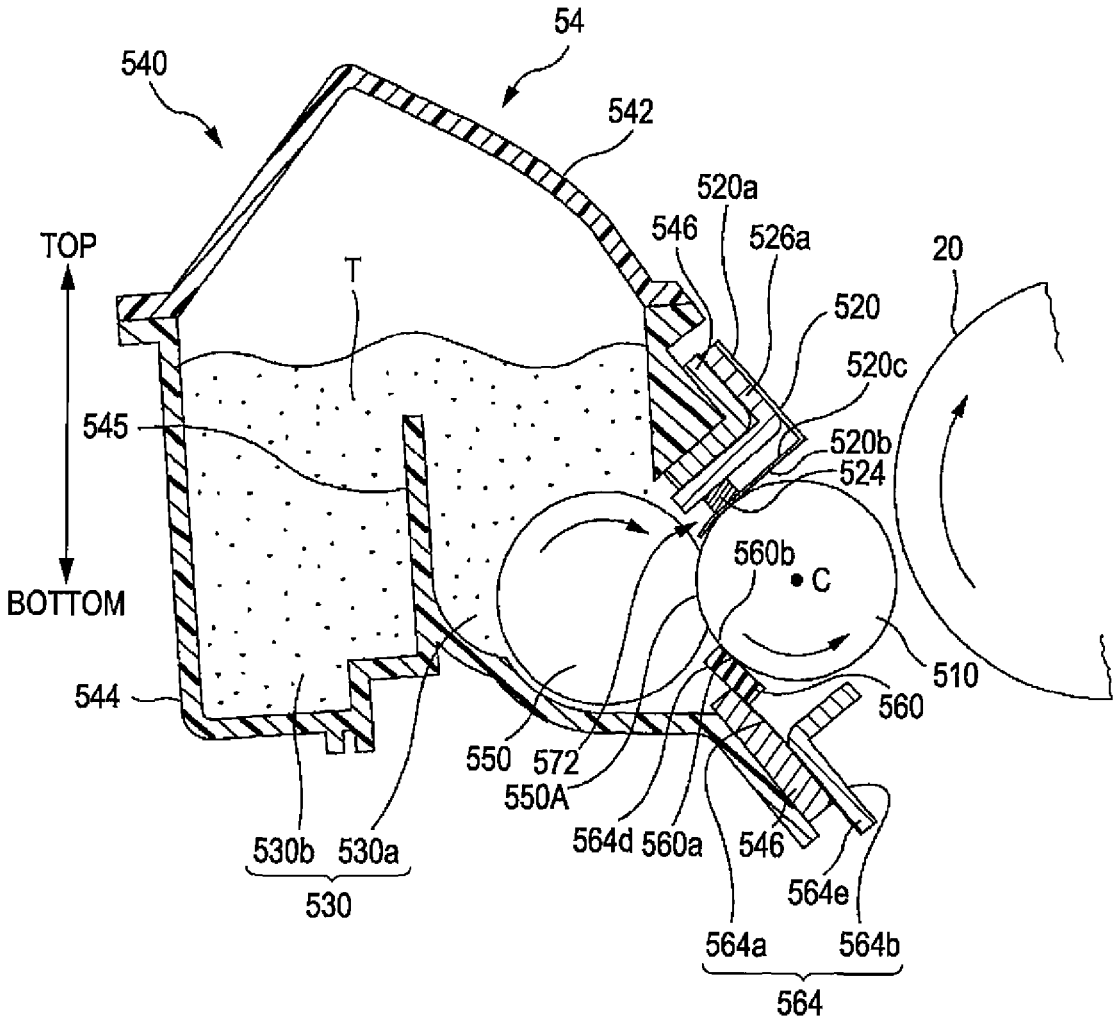
FIG. 4 is a sectional view that schematically illustrates an example of the configuration of the major components of the development apparatus according to an exemplary embodiment of the invention.
Figure 5:
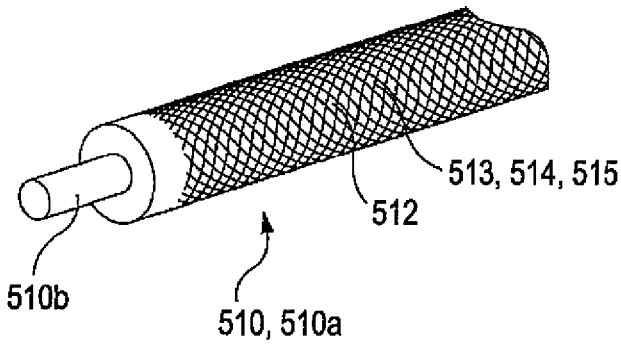
FIG. 5 is a perspective view that schematically illustrates an example of the configuration of a development roller 510 according to an exemplary embodiment of the invention.
Figure 6:
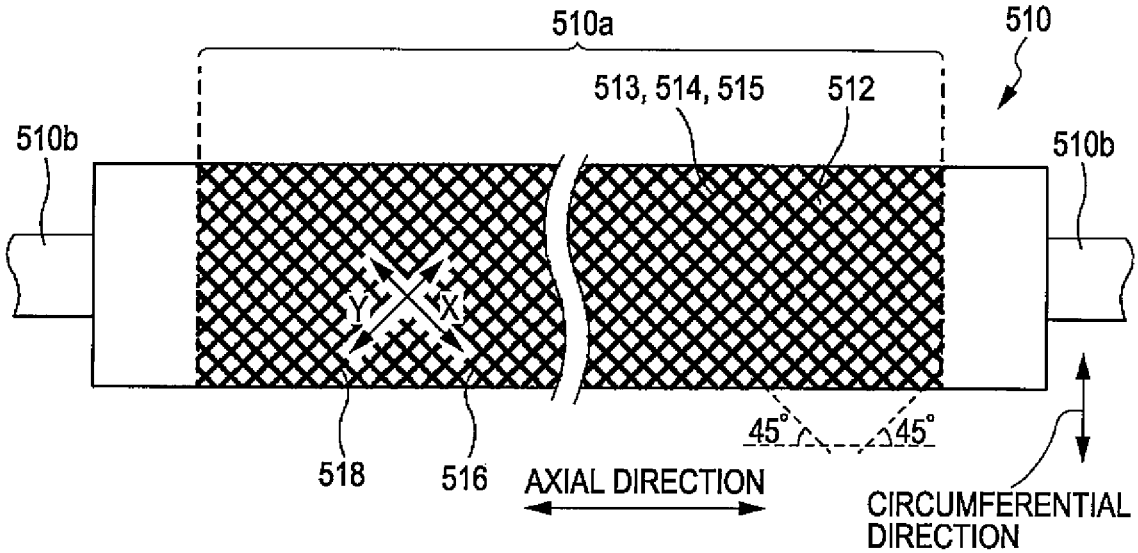
FIG. 6 is a front view that schematically illustrates an example of the configuration of the development roller 510 according to an exemplary embodiment of the invention.
Figure 7A:
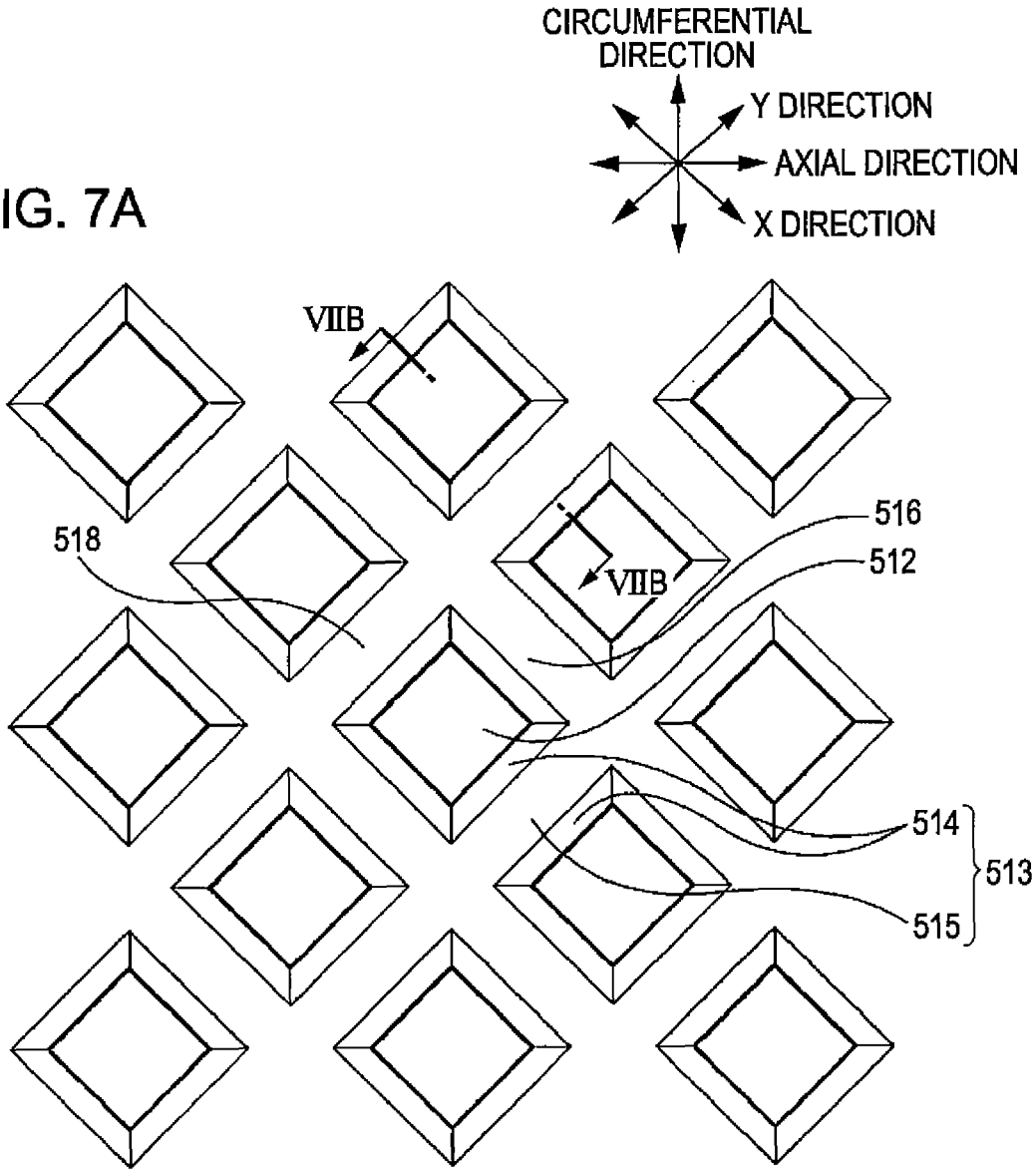
FIGS. 7A and 7B is a set of diagrams that schematically illustrates an example of the shapes of a convex portion 512, a concave portion 515, and other portions and regions according to an exemplary embodiment of the invention, where
Figure 7B:
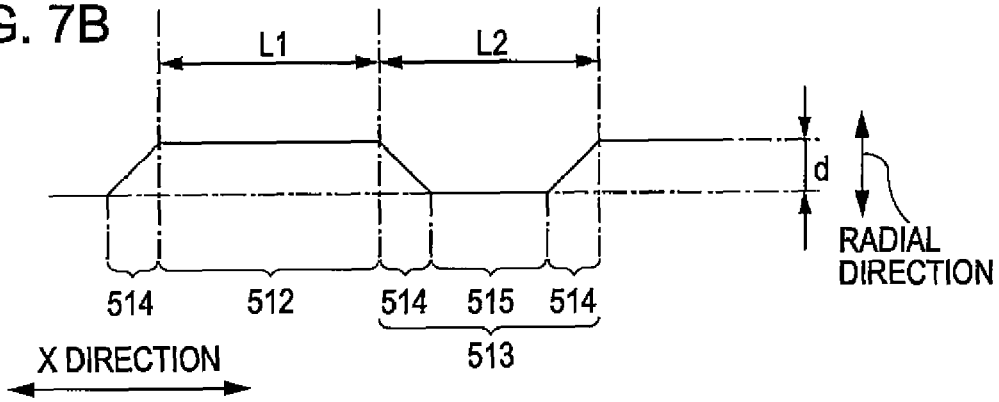
Figure 8:
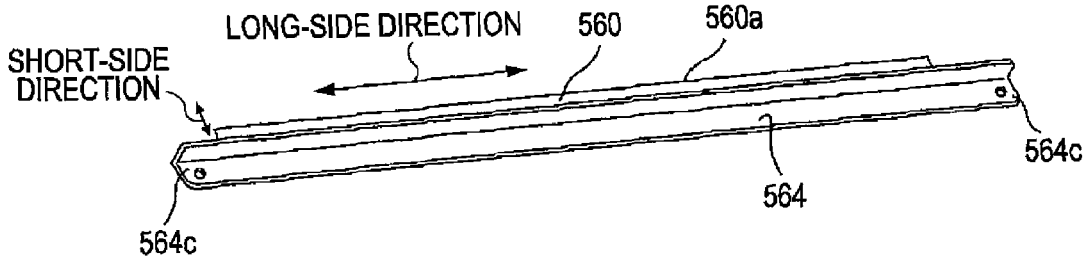
FIG. 8 is a perspective view that schematically illustrates an example of the configuration of a toner-layer-thickness controlling blade 560 and a blade-supporting member 564 according to an exemplary embodiment of the invention.
Figure 9:
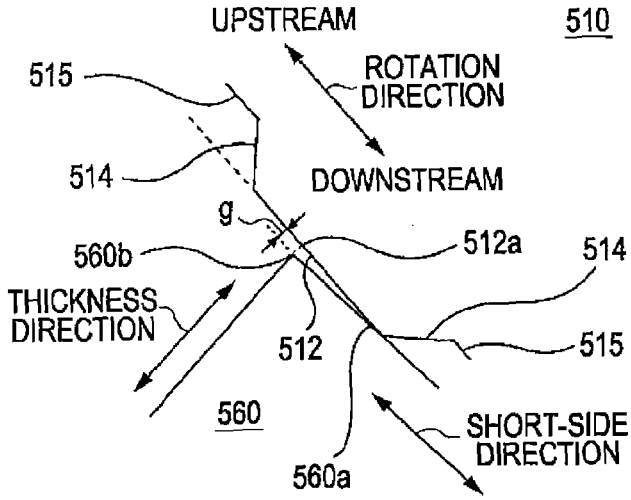
FIG. 9 is an enlarged view that schematically illustrates an exemplary configuration of the tip 560*b* of the toner-layer-thickness controlling blade 560, where the toner-layer-thickness controlling blade 560 is in contact with the development roller 510, shown together with the peripheral region around the tip 560*b* thereof according to an exemplary embodiment of the invention.
Figure 10:
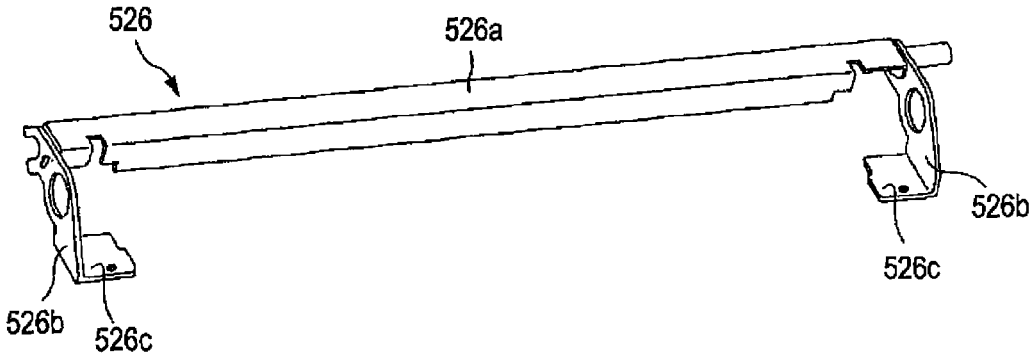
FIG. 10 is a perspective view that schematically illustrates an example of the configuration of a holder 526 according to an exemplary embodiment of the invention.
Figure 11:
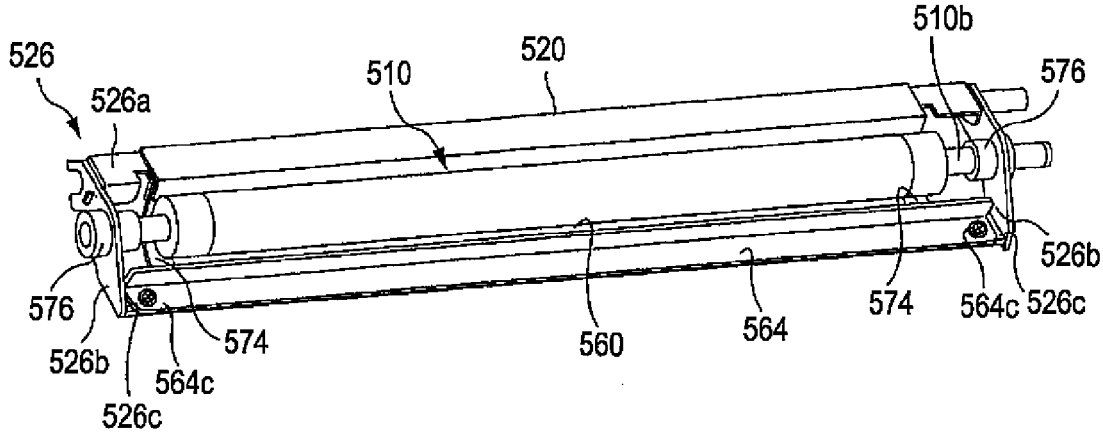
FIG. 11 is a perspective view that schematically illustrates an example of an in-process assembled components of a development apparatus according to an exemplary embodiment of the invention, where an upside sealing member 520, the development roller 510, the toner-layer-thickness controlling blade 560, and the blade-supporting member 564 are assembled on the holder 526.
Figure 12:
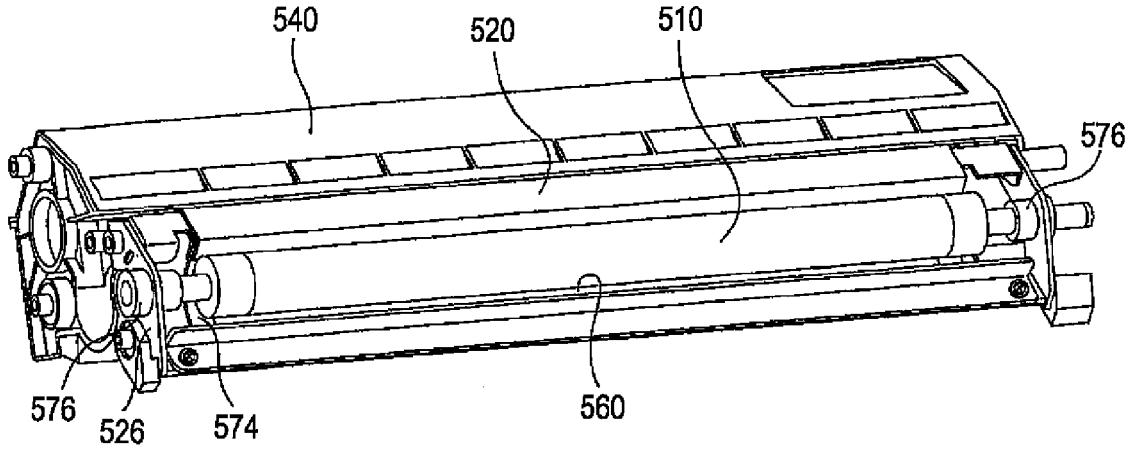
FIG. 12 is a perspective view that schematically illustrates another example of in-process assembled components of a development apparatus according to an exemplary embodiment of the invention, where the holder 526 of the assembled components illustrated in FIG. 11 is attached to a housing 540.
Figure 13:
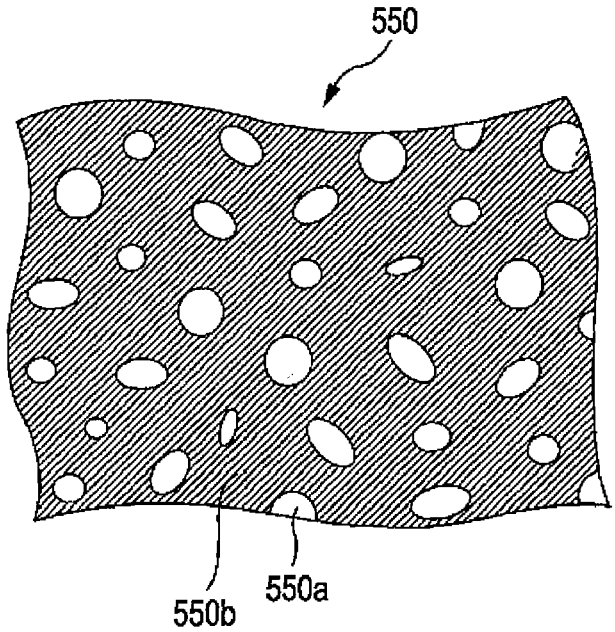
FIG. 13 is an enlarged view that schematically illustrates an example of the surface of a toner-supplying roller 550 according to an exemplary embodiment of the invention.

Next, with reference to FIGS. 3-12, an exemplary configuration of a development apparatus is explained below. FIG. 3 is a perspective view that schematically illustrates an example of the configuration of a development apparatus according to an exemplary embodiment of the invention. FIG. 4 is a sectional view that schematically illustrates an example of the configuration of the major components of the development apparatus according to an exemplary embodiment of the invention. FIG. 5 is a perspective view that schematically illustrates an example of the configuration of a development roller 510 according to an exemplary embodiment of the invention. FIG. 6 is a front view that schematically illustrates an example of the configuration of the development roller 510 according to an exemplary embodiment of the invention. FIGS. 7A and 7B is a set of diagrams that schematically illustrates an example of the shapes of a convex portion 512, a concave portion 515, and other portions and regions according to an exemplary embodiment of the invention, where FIG. 7B illustrates a sectional view taken along the line VIIB-VIIB of FIG. 7A. FIG. 8 is a perspective view that schematically illustrates an example of the configuration of a toner-layer-thickness controlling blade 560 and a blade-supporting member 564 according to an exemplary embodiment of the invention. FIG. 9 is an enlarged view that schematically illustrates an exemplary configuration of the tip 560*b* of the toner-layer-thickness controlling blade 560, where the toner-layer-thickness controlling blade 560 is in contact with the development roller 510, shown together with the peripheral region around the tip 560*b* thereof according to an exemplary embodiment of the invention. FIG. 10 is a perspective view that schematically illustrates an example of the configuration of a holder 526 according to an exemplary embodiment of the invention. FIG. 11 is a perspective view that schematically illustrates an example of an in-process assembled components of a development apparatus according to an exemplary embodiment of the invention, where an upside sealing member 520, the development roller 510, the toner-layer-thickness controlling blade 560, and the blade-supporting member 564 are assembled on the holder 526. FIG. 12 is a perspective view that schematically illustrates another example of in-process assembled components of a development apparatus according to an exemplary embodiment of the invention, where the holder 526 of the assembled components illustrated in FIG. 11 is attached to a housing 540. FIG. 13 is an enlarged view that schematically illustrates an example of the surface of a toner-supplying roller 550 according to an exemplary embodiment of the invention. The sectional view of a development apparatus illustrated in FIG. 4 is taken along a virtual plane that is perpendicular to the long-side direction thereof shown in FIG. 3. The double-headed arrow shown in FIG. 4 indicates the vertical orientation of a development apparatus, as done so in FIG. 1. For example, as the positional relationship illustrated in FIG. 4 indicates, the center axis of the development roller 510 is below the center axis of the photosensitive member 20. FIG. 4 illustrates a yellow development state where the yellow development apparatus 54 is set at the development position so that it faces the photosensitive member 20. It should be noted that, in FIGS. 5, 6, 7, and 9, the dimensions and/or scales of the concave portion(s) 512 and other portions are modified from those that will be adopted in an actual implementation of the invention for the purpose of making them easily recognizable in each illustration. Each of the long-side direction of the toner-layer-thickness controlling blade 560 and the short-side direction thereof is shown by means of a double-headed arrow in FIG. 8, whereas each of the short-side direction of the toner-layer-thickness controlling blade 560 and the blade-thickness direction thereof is shown by means of a double-headed arrow in FIG. 9.

The YMCK rotary developing unit 50 is provided with the black development apparatus 51 that contains the black (K) toner, the magenta development apparatus 52 that contains the magenta (M) toner, the cyan development apparatus 53 that contains the cyan (C) toner, and the yellow development apparatus 54 that contains the yellow (Y) toner. In the following description, since the yellow development apparatus 54 has the same configuration as those of other three development apparatuses, the exemplary configuration of the yellow development apparatus 54 only is explained so as to omit redundant explanation.

The yellow development apparatus 54 is provided with, though not limited thereto, a development roller 510, an upside sealing member (i.e., upper-side sealing member) 520, a toner container 530, a housing 540, a toner-supplying roller 550, a toner-layer-thickness controlling blade 560, and a holder 526. The development roller 510 constitutes a non-limiting example of a "toner carrier" according to the invention. The toner-supplying roller 550 constitutes a non-limiting example of a "removing member" according to the invention. The toner-layer-thickness controlling blade 560 constitutes a non-limiting example of a "layer-thickness controlling member" according to the invention.

The development roller 510 carries toner T. As the development roller 510 rotates, the toner T carried by the development roller 510 is transported to a development position, which is a location at which the development roller 510 faces the photosensitive member 20. At the development position, the development roller 510 develops a latent image formed on the photosensitive member 20 by means of the toner T carried thereon (i.e., by the development roller 510). The development roller 510 is a member that is made of, for example, aluminum alloy or iron alloy, though not limited thereto.

The development roller 510 has "convex" portions 512 and "non-convex" portions 513 on the surface of the middle roller body portion 510*a* thereof. Herein, the term "middle" is used to refer to not restrictively the center region of the surface thereof but a broader cylindrical surface region thereof including the center region thereof while excluding end regions thereof. The same applies hereunder. The non-convex portions 513 include side portions 514 and "concave" portions 515. As will become clear from the following description and accompanying drawings, the terms "convex" (and "non-convex") as well as "concave" (and "non-concave") might have special connotation and/or meaning in this specification, the definition of which might differ from their customary meaning. As illustrated in FIGS. 5, 6, and 7, these convex portions 512 and non-convex portions 513 are formed on the surface of the development roller 510 in a regular array pattern.

In the configuration of the yellow development apparatus 54 (or more specifically, the yellow development roller 510 thereof) according to the present embodiment of the invention, each of these convex portions 512 and non-convex portions 513, the latter of which is a generic concept that encompasses the side portions 514 and the concave portions 515, function as a toner-carrying region that carries the toner T. Having these convexities and concavities, the development roller 510 develops a latent image formed on the photosensitive member 20 by means of the toner T that is carried on/in the convex portions 512, the side portions 514, and the concave portions 515. It should be noted that the convex portions 512 and the side portions 514 make up "non-concave portions" in the configuration of the development roller 510 according to the present embodiment of the invention.

Each of the convex portions 512 constitutes the highest region of the middle roller body portion 510*a* of the development roller 510. As illustrated in the upper-part drawing of FIG. 7, which is a two-part figure, each of the convex portions 512 is formed as a flat top face having the shape of a square. The length of each side of each of the square-shaped convex portions 512, which is denoted as L1 in the lower-part drawing of FIG. 7, is approximately 50 μm. These square-shaped convex portions 512 are formed on the surface of the middle roller body portion 510*a* of the development roller 510 in such an array pattern that one of two diagonal lines of the square extends along the rotation axis of the development roller 510 whereas the other of two diagonal lines thereof extends in the circumferential direction of the development roller 510.

In the configuration of the development roller 510 according to the present embodiment of the invention, the non-convex portions 513 are made up of a first groove region 516 and a second groove region 518. The first groove region 516 is formed to have a thread-groove pattern, that is, a spiral direction, which differs from that of the second groove region 518. In other words, the first groove region 516 is formed to have an angle of gradient viewed with respect to the circumferential direction of the development roller 510 that differs from that of the second groove region 518. Specifically, the first groove region 516 is formed as spiral-pattern grooves, the long-side extending direction of each of which is denoted as X in FIG. 6. The second groove region 518 is also formed as spiral-pattern grooves, the long-side extending direction of each of which is denoted as Y therein. Accordingly, the first groove region 516 and the second groove region 518 intersect with each other, thereby forming a grid pattern The first groove region 516 and the second groove region 518 surrounds each of the convex portions 512. The long-side extending direction of each of the first groove region 516 and the second groove region 518 makes an acute angle of approximately forty-five (45) degrees with the rotation-axis direction of the development roller 510 as illustrated in FIG. 6. The groove width of each of the first groove region 516 and the second groove region 518 viewed in the short-side direction thereof, which is denoted as L2 in the lower-part drawing of FIG. 7, is approximately 50 μm, which is the same dimension as the aforementioned length L1 of each side of each of the square-shaped convex portions 512. Or, in other words, the distance between one convex portion 512 and another convex portion 512 that is arrayed adjacent to the above-mentioned one convex portion 512 is the same as the length L1 of each side of each of the square-shaped convex portions 512, that is, approximately 50 μm.

Each of the side portions 514 is formed as a slope that extends from the convex portion 512 to the concave portion 515. As illustrated in the upper-part drawing of FIG. 7, four side-slope portions 514 are formed around the sides of each of the square-shaped convex portions 512. As illustrated in FIGS. 5, 6, and 7, a number of convexes in their usual and customary meaning, each of which is formed as a combination of one "convex" portion (note that it refers to the flat square top face in this specification) 512 and four side-slope portions 514, are formed on the surface of the middle roller body portion 510*a* of the development roller 510 in a regular and "mesh" pattern.

The concave portions (hereafter might be expressed in its singular form as a concave portion, where the singularity/plurality thereof is used in this specification without any intention to limit the scope of the invention) 515 are formed as the bottom region of the non-convex portions (hereafter might be expressed in its singular form as a non-convex portion, where the singularity/plurality thereof is used in this specification without any intention to limit the scope of the invention) 513. That is, the concave portion 515 is formed as the bottom of the first groove region 516/second groove region 518. The concave portion 515 constitutes the lowest region of the middle roller body portion 510*a* of the development roller 510. As illustrated in FIGS. 5, 6, and 7, the concave portion 515 surrounds all four sides of each combination of one convex portion 512 and four side-slope portions 514. Therefore, the concave portion 515 has a regular and net-like pattern that corresponds to the aforementioned regular and mesh pattern formed by the aforementioned many convexes in their usual and customary meaning each of which is formed as the combination of one convex portion 512 and four side-slope portions 514. The depth of the concave portion 515, that is, the depth of the non-convex portion 513, which is measured from the convex portions (i.e., flat top face) 512 and denoted as "d" in the lower-part drawing of FIG. 7, is approximately 8 μm. Or, in other words, the distance from the convex portions 512 to the concave portion 515 that is measured in the radial direction of the development roller 510 is approximately 8 μm. The convex portions 512 and the concave portions 515 of the development roller 510 are formed in such a manner that these convex portions 512 and concave portions 515 have the uniform distance (i.e., depth) d of 8 μm therebetween. In the present embodiment of the invention, the toner T has a particulate structure; or, in other words, it is formed as minute particles. In addition, the volume mean diameter (i.e., average particle size) of the toner T according to the present embodiment of the invention is approximately 3 μm. Accordingly, the depth d, which is approximately 8 μm, of the concave portion 515 is larger than twice of the volume mean particle diameter of the toner T, which is approximately 3 μm. In addition, the depth of the concave portion 515 is smaller than the volume mean particle diameter of the toner T multiplied by three. This means that the number of layers of the toner T, which has the volume mean particle diameter of 3 μm according to the present embodiment of the invention, carried on (i.e., in) the non-convex portion 513 is smaller than three.

Electro-less Ni—P plating is applied to the surface of the middle roller body portion 510*a* of the development roller 510, which has the convex portions 512, the side portions 514, and the concave portion 515 formed therein.

The development roller 510 has a roller shaft portion 510*b*. A pair of developing-roller supporting portions 526*b* of the holder 526 supports the roller shaft portion 510*b* of the development roller 510 by means of a pair of roller shaft bearings 576, as illustrated in FIG. 11. A more detailed explanation of the holder 526 will be given later. The above-described mechanical support structure allows the development roller 510 to rotate freely. As illustrated in FIG. 4, the development roller 510 rotates in a direction reverse to the rotation direction of the photosensitive member 20. Specifically, the development roller 510 rotates in a counterclockwise direction (refer to FIG. 4) that is reverse to the rotation direction (clockwise direction; refer to FIG. 4) of the photosensitive member 20. In the configuration of the yellow development apparatus 54 according to the present embodiment of the invention, there is a difference between the circumferential velocity of the development roller 510 and that of the photosensitive member 20. Specifically, the moving speed of the surface of the development roller 510 measured at the time of the rotation thereof is 1.4 times greater (i.e., faster) than that of the photosensitive member 20 measured at the time of the rotation thereof. Or, in other words, the ratio of the moving speed of the circumferential surface of the development roller 510 to the moving speed of the circumferential surface of the photosensitive member 20 is 1.4:1.

When the yellow development apparatus 54 and the photosensitive member 20 face each other, there is a clearance between the development roller 510 and the photosensitive member 20. The printer 10 is provided with a development bias application unit 121 (refer to FIG. 2) that applies a development bias to the development roller 510 for the purpose of the development of a latent image. The development bias is a DC-AC superposed voltage that is formed by superposing an alternating voltage onto a direct-current voltage. The development bias constitutes a non-limiting example of a "development voltage" according to the invention. The development bias application unit 121 constitutes a non-limiting example of a "voltage application section" according to the invention. An alternating electric field is generated at the clearance between the development roller 510 and the photosensitive member 20 as a result of the application of a development bias to the development roller 510. The toner T carried on the development roller 510 moves to the photosensitive member 20 due to the generation of the alternating electric field. Consequently, a latent image formed on the photosensitive member 20 is developed.

The aforementioned housing 540 is made up of an upper housing portion 542 and a lower housing portion 544, which are weld-deposited to each other. Each of the upper housing portion 542 and the lower housing portion 544 is a molded housing member that is made of resin. The housing 540 has the aforementioned toner container 530 formed therein. As its name suggests, the toner container 530 contains toner T. An inner partition wall 545 projects from the inner wall of the lower housing portion 544 of the housing 540 in an inward direction. Specifically, in the configuration of the yellow development apparatus 54 according to the present embodiment of the invention, the inner partition wall 545 projects upward as illustrated in FIG. 4. Because of the presence of the inner partition wall 545 having such a structure, the toner container 530 is divided in two toner compartments, that is, a first toner containing portion 530*a* and a second toner containing portion 530*b*. As illustrated in FIG. 4, the upper toner-containing space of the first toner containing portion 530*a* is in communication with the upper toner-containing space of the second toner containing portion 530*b* above the inner partition wall 545, whereas the inner partition wall 545 does not allow the toner T to move from the first toner containing portion 530*a* to the second toner containing portion 530*b* or vice versa except that the movement of the toner T therebetween is partially allowed through the upper toner-containing space of the first toner containing portion 530*a* and the upper toner-containing space of the second toner containing portion 530*b* that are in communication with each other over the inner partition wall 545. As illustrated in FIG. 4, the housing 540, or more specifically, the first toner containing portion 530*a*, has an opening 572 that is formed at a lower region thereof. The development roller 510 is provided in such a manner that a circumferential surface thereof faces the opening 572. Accordingly, a part of the development roller 510 is exposed thereat.

The toner-supplying roller 550 is provided in the first toner containing portion 530*a* of the toner container 530, which constitutes one of two toner compartments described above. The toner-supplying roller 550 supplies the toner T that is contained in the first toner containing portion 530*a* to the development roller 510. The surface of the toner-supplying roller 550 is made of a porous foam material having elasticity. An example of such a porous foam material having elasticity is urethane foam, though not limited thereto. The toner-supplying roller 550 is in contact with the development roller 510 in an elastically deformed state at a contact region 550A thereof. The toner-supplying roller 550 retains, that is, carries, the toner T, which is contained in the first toner containing portion 530*a*, in pores (i.e., holes) 550*a* formed on the surface thereof. The pores 550*a* are shown as un-hatched blank elliptic regions in FIG. 13. As illustrated in FIG. 4, the toner-supplying roller 550 rotates in a direction reverse to the rotation direction of the development roller 510. Specifically, the toner-supplying roller 550 rotates in a clockwise direction (refer to FIG. 4) that is reverse to the rotation direction (counterclockwise direction; refer to FIG. 4) of the development roller 510. As the toner-supplying roller 550 rotates, the toner T that is retained in the pores 550*a* formed thereon is transported to a contact position at which the toner-supplying roller 550 contacts the development roller 510. Then, the toner T is charged due to triboelectrification (i.e., frictional electrification) at the contact position of the toner-supplying roller 550 and the development roller 510. Subsequently, the electrified toner T adheres to the development roller 510. As a result thereof, the toner T is carried on (i.e., by) the development roller 510. In this way, the toner-supplying roller 550 supplies the toner T to the development roller 510.

In addition to the function of supplying toner T to the development roller 510 as described above, the toner-supplying roller 550 has another function of removing any residue toner T that remains on the development roller 510 after development therefrom. Specifically, the toner-supplying roller 550 removes residue toner T that remains on the circumferential surface of the development roller 510 after the completion of development therefrom (i.e., from the circumferential surface of the development roller 510) as follows. The toner-supplying roller 550 has a wall region 550*b* on its circumferential surface. The wall region 550*b* of the toner-supplying roller 550 surrounds each of the pores 550*a* formed therein. The wall region 550*b* is shown as a hatched region in FIG. 13. Among the entire area of the contact region 550A of the toner-supplying roller 550, the wall region 550*b* thereof becomes in contact with the development roller 510 so as to remove the residue toner T therefrom. That is, the wall region 550*b* of the toner-supplying roller 550 functions as a main region that removes the residue toner T that remains on the development roller 510.

The upside sealing member 520 contacts the development roller 510 along the rotation-axis direction thereof. Being provided at a downstream position relative to the development position, or in other words, after the passage thereof through the development position, the upside sealing member 520 allows the residue toner T that remains on the circumferential surface of the development roller 510 to move into the housing 540 while preventing toner T that is contained in the housing 540 from moving out of the housing 540. The upside sealing member 520 is a sealant that is made of, for example, a polyethylene film, though not necessarily limited thereto. The upside-sealant supporting portion 526*a* of the holder 520, which will be described later, supports the upside sealant (i.e., upside sealing member) 520. The upside sealant 520 is provided in such a manner that the long-side direction of the upside sealant 520 is in alignment with the rotation-axis direction of the development roller 510 as illustrated in FIG. 11.

An upper-sealant urging member 524 is provided on one surface of the upper sealant 520 that is opposite the other surface thereof that contacts the development roller 510. The second-mentioned other surface of the upper sealant 520 that contacts the development roller 510 is referred to as a contact surface 520*b*. On the other hand, the first-mentioned one surface of the upper sealant 520 on which the upper-sealant urging member 524 is provided is referred to as an opposite surface 520*c*. Specifically, the upper-sealant urging member 524 is provided between the opposite surface 520*c* of the upper sealant 520 and the upside-sealant supporting portion 526*a*. The upper-sealant urging member 524 is made of an elastic member such as a "moltopren", though not limited thereto. The upper-sealant urging member 524 is provided therebetween in a compressed state. The upper-sealant urging member 524 applies an urging force onto the upper sealant 520 toward the development roller 510. By this means, the upper-sealant urging member 524 presses the upper sealant 520 against the development roller 510.

The toner-layer-thickness controlling blade 560 is provided in such a manner that it extends from one end region of the development roller 510 as viewed along the rotation axis thereof to the other end region thereof. Accordingly, the toner-layer-thickness controlling blade 560 is provided in such a manner that the long-side direction thereof is in alignment with the rotation-axis direction of the development roller 510. The contact region 560*a* of the toner-layer-thickness controlling blade 560 contacts the circumferential surface of the development roller 510. As its name suggests, the toner-layer-thickness controlling blade 560 controls (i.e., adjusts) the layer thickness of the toner T carried on the development roller 510, or more specifically, the layer thickness of the toner T carried on/in the convex portions 512 and the non-convex portion 513 of the development roller 510. In addition thereto, the toner-layer-thickness controlling blade 560 applies an electric charge to the toner T that is carried on the development roller 510. Through the adjustment of the layer thickness of toner T that is carried on the development roller 510, the toner-layer-thickness controlling blade 560 controls the amount of the toner T carried on the development roller 510.

The toner-layer-thickness controlling blade 560 is made of, for example, silicon rubber or polyurethane rubber, though not limited thereto. As illustrated in FIGS. 4 and 8, the aforementioned blade-supporting member 564 supports the toner-layer-thickness controlling blade 560. The blade-supporting member 564 is made up of a thin plate 564*a* and a thin-plate supporting portion 564*b*. The short-side-direction one-end region 564*d* of the blade-supporting member 564 supports the toner-layer-thickness controlling blade 560. The short-side-direction one-end region 564*d* of the blade-supporting member 564 is a thin-plate-side (564*a*) end region thereof. The thin plate 564*a* of the blade-supporting member 564 is made of, for example, phosphor bronze (i.e., phosphoric bronze) or stainless steel, though not limited thereto. The thin plate 564*a* of the blade-supporting member 564 has spring elasticity. The thin plate 564*a* of the blade-supporting member 564 directly supports the toner-layer-thickness controlling blade 560. As it applies an urging force to the toner-layer-thickness controlling blade 560, the thin plate 564*a* of the blade-supporting member 564 presses the toner-layer-thickness controlling blade 560 against the development roller 510. The thin-plate supporting portion 564*b* of the blade-supporting member 564 is a metal plate that is provided at the short-side-direction other-end region 564*e* of the blade-supporting member 564. The thin-plate supporting portion 564*b* of the blade-supporting member 564 and the thin plate 564*a* thereof are fixed to each other in such a manner that the thin-plate supporting portion 564*b* thereof supports one end of the thin plate 564*a* thereof that is opposite to the other end of the thin plate 564*a* where the toner-layer-thickness controlling blade 560 is supported. That is, the thin-plate supporting portion 564*b* of the blade-supporting member 564 supports the non-blade-supporting end of the thin plate 564*a*. The toner-layer-thickness controlling blade 560 and the blade-supporting member 564 are attached to a pair of controlling-blade supporting portions 526*c* of the holder 526, which will be described later. Specifically, the pair of controlling-blade supporting portions 526*c* of the holder 526 supports the long-side-direction both-end regions 564*c* of the thin-plate supporting portion 564*b* of the blade-supporting member 564 so as to provide a mechanical support to the toner-layer-thickness controlling blade 560 and the blade-supporting member 564.

Moreover, the toner-layer-thickness controlling blade 560 is provided in such an orientation that, as illustrated in FIG. 9, the tip 560*b* of the toner-layer-thickness controlling blade 560 as viewed along the short-side direction and the thickness direction thereof faces toward the upstream side of the development roller 510 as viewed in the rotation direction thereof. That is, the toner-layer-thickness controlling blade 560 is provided in a so-called counter contact orientation.

Moreover, the tip 560*b* of the toner-layer-thickness controlling blade 560 is not in contact the surface of the development roller 510 as illustrated in FIG. 9, whereas the aforementioned contact region 560*a* of the toner-layer-thickness controlling blade 560 contacts the surface of the development roller 510 as illustrated therein. It should be noted that the contact region 560*a* of the toner-layer-thickness controlling blade 560, at which the toner-layer-thickness controlling blade 560 contacts the surface of the development roller 510, is located at a position that is distanced from the tip 560*b* of the toner-layer-thickness controlling blade 560. Furthermore, in the configuration of the yellow development apparatus 54 according to the present embodiment of the invention, a momentary distance from the tip 560*b* of the toner-layer-thickness controlling blade 560 to the currently facing convex portions 512 is very small, which is measured at the time when the tip 560*b* of the toner-layer-thickness controlling blade 560 faces the convex portions 512 of the rotating development roller 510 among the entire circumferential surface thereof including the convex portions 512 and the concave portion 515. FIG. 9 shows an example of such a moment at which, as the development roller 510 rotates, the tip 560*b* of the toner-layer-thickness controlling blade 560 comes to a position that faces the convex portions 512 of the rotating development roller 510. The very small distance that is measured from the tip 560*b* of the toner-layer-thickness controlling blade 560 to the currently facing convex portions 512 of the rotating development roller 510 at the above-described moment is denoted as "g" in FIG. 9. In addition, the opposite region of the convex portions 512 of the rotating development roller 510 that faces the tip 560*b* of the toner-layer-thickness controlling blade 560 at the above-described moment is denoted by means of a reference numeral 512*a* in FIG. 9. Herein, it is assumed that a virtual line is drawn from the tip 560*b* of the toner-layer-thickness controlling blade 560 to the cross-sectional center of the development roller 510, which is denoted as C in FIG. 4. On the basis of such an assumption, the distance g that is measured from the tip 560*b* of the toner-layer-thickness controlling blade 560 to the opposite region 512*a* of the currently facing convex portions 512 of the rotating development roller 510 at the above-described moment equals to the length of a virtual segment (i.e., virtual line segment) that goes from a point of intersection of the above-mentioned assumed virtual line and the currently facing convex portions (i.e., top face) 512 of the rotating development roller 510 to the tip 560*b* of the toner-layer-thickness controlling blade 560. Specifically, the distance g is approximately 2 μm, which is smaller than the aforementioned volume mean particle diameter of the toner T, which is approximately 3 μm.

As illustrated in FIG. 11, a pair of end-region sealing members 574 is provided at the outer regions of the toner-layer-thickness controlling blade 560 as viewed along the long-side direction thereof. The pair of end-region sealing members 574 is made of a non-woven fabric or the like. The pair of end-region sealing members 574 is provided around the circumferential surface of the development roller 510 at the edge regions (i.e., end regions) thereof viewed in the direction of the rotation axis thereof so as to provide a liquid-tight sealing thereat. By this means, the pair of end-region sealing members 574 prevents the leakage of toner T, which could occur through a gap between the circumferential surface of the development roller 510 at the edge regions thereof and the housing 540 unless these end-region sealing members 574 provide the liquid-tight sealing thereat.

The holder 526 is a metal frame member to which various components of the yellow development apparatus 54 according to the present embodiment of the invention, including but not limited to the yellow development roller 510 thereof, are assembled and attached to. As illustrated in FIG. 10, the holder 526 has the aforementioned upside-sealant supporting portion 526*a*, the aforementioned pair of developing-roller supporting portions 526*b*, and the aforementioned pair of controlling-blade supporting portions 526*c*. The upside-sealant supporting portion 526*a* of the holder 526 has an elongated body that extends in the long-side direction of the holder 526, or, in other words, is in alignment with the rotation-axis direction of the development roller 510. The pair of developing-roller supporting portions 526*b* is provided at the outer regions (i.e., end regions) of the elongated upside-sealant supporting portion 526*a* of the holder 526 as viewed in the long-side direction (i.e., rotation-axis direction). Each of the pair of developing-roller supporting portions 526*b* has a body that extends in a perpendicular direction with respect to the long-side direction (i.e., rotation-axis direction) of the elongated upside-sealant supporting portion 526*a* of the holder 526. Each of the pair of controlling-blade supporting portions 526*c* has a body that extends in a perpendicular direction with respect to the corresponding one of the pair of developing-roller supporting portions 526*b*. Each of the pair of controlling-blade supporting portions 526*c* faces the corresponding one of the long-side-direction end regions of the elongated upside-sealant supporting portion 526*a* of the holder 526.

As illustrated in FIG. 11, the upside-sealant supporting portion 526*a* of the holder 526 supports the upside sealing member 520 at the short-side-direction end region 520*a* (refer to FIG. 4) of the upside sealing member 520. In addition, as also illustrated in FIG. 11, the pair of developing-roller supporting portions 526*b* of the holder 526 supports the roller-shaft end regions of the development roller 510.

The pair of controlling-blade supporting portions 526*c* of the holder 526 provides a mechanical support, at the long-side-direction both-end regions 564*c* of the blade-supporting member 564, to the toner-layer-thickness controlling blade 560 and the blade-supporting member 564. The assembly made up of the toner-layer-thickness controlling blade 560 and the blade-supporting member 564 is fastened to the pair of controlling-blade supporting portions 526*c* of the holder 526 by means of screws.

As illustrated in FIG. 12, the assembled holder 526 to which the upside sealing member 520, the development roller 510, the toner-layer-thickness controlling blade 560, and the blade-supporting member 564 are attached as described above is mounted into the aforementioned housing 540 with a housing sealant member 546 (refer to FIG. 4) being interposed therebetween. The housing sealant member 546 prevents the toner T from leaking through a gap between the holder 526 and the housing 540.

The yellow development apparatus 54 according to the present embodiment of the invention, which has the configuration described above, operates as follows. The toner-supplying roller 550 supplies toner T that is contained in the toner container 530 to the development roller 510. When the toner-supplying roller 550 supplies toner T to the development roller 510, the toner T is charged due to triboelectrification, that is, frictional electrification, at the contact position of the toner-supplying roller 550 and the development roller 510. Subsequently, the electrified toner T adheres to the development roller 510. As a result thereof, the toner T is carried on the development roller 510. As the development roller 510 rotates, the toner T that is carried on the development roller 510 reaches the toner-layer-thickness controlling blade 560. The toner-layer-thickness controlling blade 560 adjusts the amount of the toner T, and then further charges the toner T due to frictional electrification. As the development roller 510 further rotates, the toner T that is carried on the development roller 510 arrives at a development position at which the development roller 510 faces the photosensitive member 20. At the development position, the toner T is used for developing a latent image that is formed on the photosensitive member 20 under an alternating electric field. As the development roller 510 further rotates, the toner T that is carried by the development roller 510 and has passed through the development position goes through the upside sealing member 520. Without being scraped off by the upside sealing member 520, the toner T that is carried on the development roller 510 is collected into the yellow development apparatus 54. Finally, the toner-supplying roller 550 removes any residue toner T that remains on the development roller 510.

Configuration of Toner According to Present Embodiment of the Invention

Next, the configuration of toner that is used by the printer 10 according to the present embodiment of the invention is described below.

1. Particle Size of Toner

In order to enhance the quality of a final image, or in other words, in order to offer excellent dot reproduction, the particle size of toner that is used by the printer 10 according to the present embodiment of the invention is smaller than the particle size of conventional one. Specifically, the volume mean diameter of particles of conventional toner is larger than 5 μm, whereas the volume mean diameter of particles of toner that is used by the printer 10 according to the present embodiment of the invention is 5 μm or less. More preferably, as has already been mentioned earlier, the volume mean diameter Ave of particles of toner that is used by the printer 10 according to the present embodiment of the invention is approximately 3 μm. Herein, the volume mean diameter is a value that is calculated as, assuming that the volume occupancy factor of toner having the particle size of Ri (i=1, . . . , n) is denoted as Pi (i=1, . . . , n; where the sum total calculated from P1 up to Pn equals 1), the sum total of the products of Ri and Pi, where i=1, . . . , n.

2. Circularity of Toner

With a greater importance being placed on the easiness/performance of image transfer in primary image-transfer process and secondary image-transfer process, the circularity of toner that is used by the printer 10 according to the present embodiment of the invention is greater than the circularity of conventional one. Specifically, the circularity of conventional toner is less than 0.950, whereas the circularity of toner that is used by the printer 10 according to the present embodiment of the invention is 0.950 or greater. This means that toner that is used by the printer 10 according to the present embodiment of the invention is circular in a more exact sense. More preferably, the circularity of toner that is used by the printer 10 according to the present embodiment of the invention is within a range from approximately 0.960 to 0.985.

3. Charge Control Agent (CCA)

No charge control agent, that is, no electrification controlling agent, which is abbreviated as CCA, is contained in toner that is used by the printer 10 according to the present embodiment of the invention.

As a typical method for producing toner, a pulverization method and a polymerization method are known. The toner that is used by the printer 10 according to the present embodiment of the invention is produced by means of the polymerization method because the polymerization method is more suitable to be used for producing toner having a smaller particle size and greater circularity in comparison with the pulverization method. When the polymerization method is adopted for the production of toner, there is an adverse possibility that the use of any charge control agent (CCA) affects the formation of toner. For this reason, no charge control agent CCA is contained in toner that is used by the printer 10 according to the present embodiment of the invention.

A few non-limiting examples of a variety of polymerization methods are a suspension polymerization method and an emulsion polymerization method. When the suspension polymerization method is adopted, colored toner particles having a desired particle size can be obtained as follows. A monomer compound in which a polymerized monomer, a coloring agent (i.e., color pigment), a release agent, and if further necessary, a colorant, a polymerization initiator, a cross-linking agent, and other additive are dissolved or dispersed is added to a water phase that contains a suspension stabilizer (water-soluble polymer, water-insoluble inorganic matter) while stirring it, thereby obtaining granulated and polymerized particles. In this way, colored toner particles having a desired particle size can be obtained by means of the suspension polymerization method. On the other hand, when the emulsion polymerization method is adopted, colored toner particles having a desired particle size can be obtained as follows. A monomer, a release agent, and if further necessary, a polymerization initiator, and an emulsifying agent (surface-active agent), though not limited thereto, are dispersed in water for polymerization thereof. Subsequently, in an aggregation process, a coloring agent (i.e., color pigment) and a flocculating agent (electrolyte), though not limited thereto, are added thereto. In this way, colored toner particles having a desired particle size can be obtained by means of the emulsion polymerization method.

The toner that is used by the printer 10 according to the present embodiment of the invention is produced by means of the emulsion polymerization method. In the following description, as an example of the production of the aforementioned four-color toner, that is, black toner, magenta toner, cyan toner, and yellow toner, a method for producing the cyan toner by means of the emulsion polymerization method is explained.

As a first step thereof, a monomer mixture made up of styrene monomer 80 parts by mass, butyl acrylate 20 parts by mass, and acrylic acid 5 parts by mass, each of which is monomer, is added to a water solution mixture made up of water 105 parts by mass, nonionic emulsifying agent (Emalgen 950 produced by Dai-ichi Kogyo Seiyaku Co., Ltd.) 1 parts by mass, anionic emulsifying agent (Neogen R produced by Dai-ichi Kogyo Seiyaku Co., Ltd.) 1.5 parts by mass, and potassium persulfate (i.e., potassium peroxydisulfate) 0.55 parts by mass, which is a polymerization initiator. Then, it is subjected to polymerization for eight hours at 70 degrees Celsius while being stirred under a nitrogen gas stream environment. It is cooled after polymerization reaction. As a result thereof, resin emulsion having a color of milk white and a particle size of 0.25 μm is obtained.

As a next step, resin emulsion 200 parts by mass (which was obtained through the first step described above), polyethylene wax emulsion (which is a release agent produced by Sanyo Chemical Industries, Ltd.) 20 parts by mass, phthalocyanine blue (which is a coloring agent) 25 parts by mass are dispersed into 0.2 liter of water containing sodium dodecylbenzenesulfonate (which is a surface-active agent) 0.2 parts by mass. Then, diethylamine is added thereto so as to control its pH into 5.5. While stirring the obtained substance, aluminum sulfate (which is an electrolyte) 0.3 parts by mass is added thereto. Subsequently, it is subjected to a high-speed stirring by means of a stirring apparatus (TK homomixer) for dispersion thereof.

As the next step, styrene monomer 40 parts by mass, butyl acrylate 10 parts by mass, and zinc salicylate 5 parts by mass as well as water 40 parts by mass are added to the substance obtained through the above-described steps. Then, it is subjected to polymerization after the addition of a hydrogen peroxide solution thereto for two hours at a raised temperature of 90 degrees Celsius while being stirred under a nitrogen gas stream environment, thereby growing particles. After the termination of polymerization, in order to increase the bonding strength of aggregated particles, it is retained for five hours at a raised temperature of 95 degrees Celsius while controlling its pH at 5 or higher. Thereafter, the obtained particles are washed by means of water. The washed particles are vacuum-dried for ten hours at 45 degrees Celsius so as to obtain cyan toner mother particles (i.e., colored toner particles).

The colored toner particles obtained after the above-described steps are mixed with an external additive agent (specifically, silica and titania). By this means, the external additive agent is externally added to the colored toner particles. As a result thereof, cyan toner having the volume mean particle diameter of approximately 3 μm is obtained.

4. Coloring Agent (Color Pigment)

In consideration of the fact that the particle size of toner that is used by the printer 10 according to the present embodiment of the invention is smaller than that of conventional toner, the amount of a coloring agent (i.e., color pigment) contained therein is made larger than that of conventional toner. Specifically, the amount of a coloring agent contained in conventional toner is less than 10 wt %, whereas the amount of a coloring agent contained in toner that is used by the printer 10 according to the present embodiment of the invention is 10 wt % or greater. Generally speaking, as the particle size of toner becomes smaller, the amount of toner that adheres to a print target medium such as a sheet of paper becomes smaller. This means that the gray level of a printed-out image becomes lower. With due consideration being given to such a general fact, the amount of a coloring agent (i.e., color pigment) contained in toner that is used by the printer 10 according to the present embodiment of the invention is relatively large so as to make compensation for the relatively small particle size thereof.

Relationships Between Volume Mean Particle Diameter Ave of Toner, Length L1 of Convex Portions 512, Width L2 of Non-convex Portion 513 (Groove Width), and Depth d of Concave Portion 515

Figure 14:
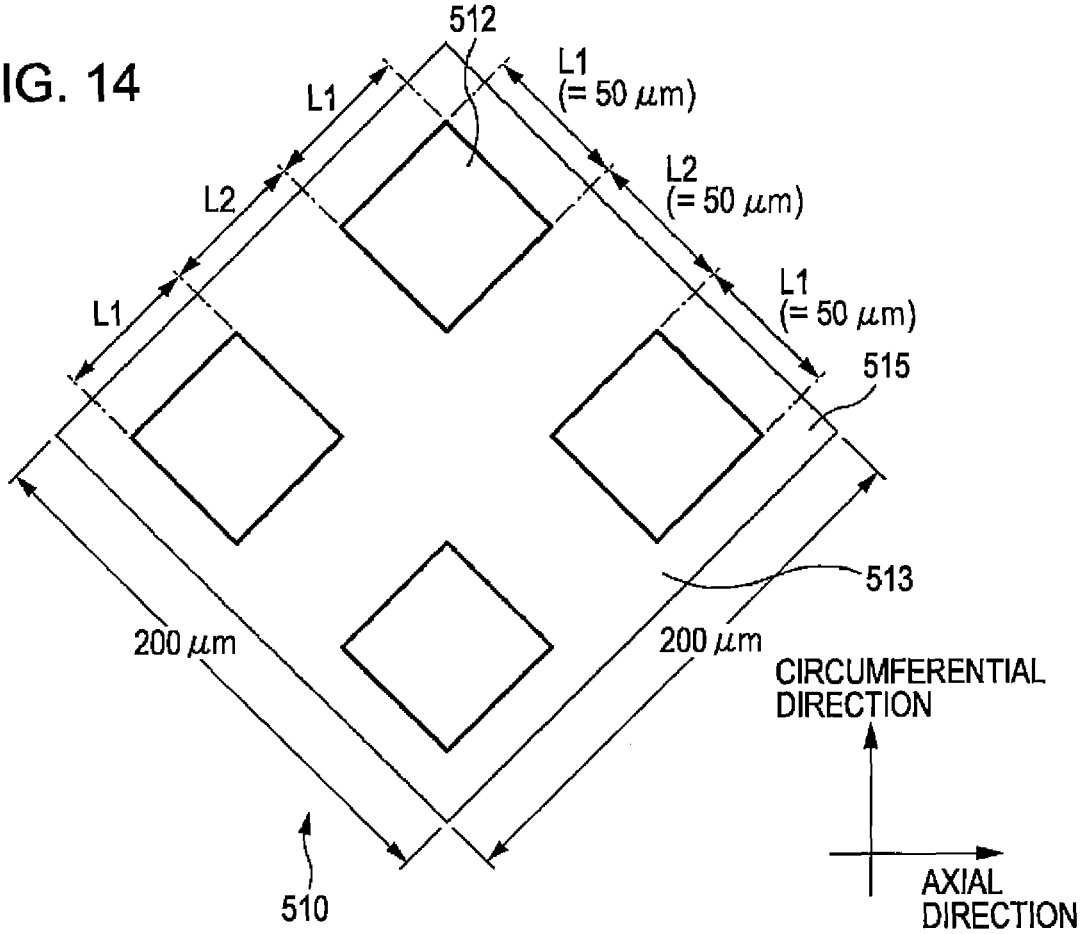
FIG. 14 is an enlarged view that schematically illustrates an example of a part of the circumferential surface of the development roller 510 according to an exemplary embodiment of the invention.

As has already been described earlier, the volume mean diameter (i.e., average particle size) of the toner T according to the present embodiment of the invention is approximately 3 μm. As has also already been described earlier, the circumferential surface of the development roller 510 on which the toner T is carried is formed in such a manner that the width L1 of each of the convex portions 512 (or, in other words, the length L1 of each side of the square-shaped top face 512) is approximately 50 μm and that the width L2 of the non-convex portion 513 (or, in other words, the groove width of each of the first groove region 516 and the second groove region 518 viewed in the short-side direction thereof) is also approximately 50 μm. In addition thereto, as has also already been described earlier, the depth d of the concave portion 515 is approximately 8 μm. In the following description, an explanation is given as to how the volume mean diameter Ave of the toner T, the width L1 of each of the convex portions 512, the width (i.e., groove width) L2 of the non-convex portion 513, and the depth d of the concave portion 515 according to the present embodiment of the invention was determined while making reference to FIG. 14. FIG. 14 is an enlarged view that schematically illustrates an example of a part of the circumferential surface of the development roller 510 according to the present embodiment of the invention. In order to simplify explanation, the side portions 514 are not illustrated in FIG. 14.

As has already been described above, the particle size of toner predominantly affects the picture quality of an image. Therefore, the volume mean diameter Ave of the toner T is determined prior to the determination of other three dimensions, that is, the width L1 of each of the convex portions 512, the width L2 of the non-convex portion 513, and the depth d of the concave portion 515. From the viewpoint of offering excellent dot reproduction, it is preferable that the particle size of toner should be as small as possible. On the other hand, there is a technical limit in the reduction of the particle size of toner that is actually produced. In order to balance these conflicting requirements, the toner T that is used by the printer 10 according to the present embodiment of the invention has the volume mean diameter Ave of 3 μm.

Figure 20:
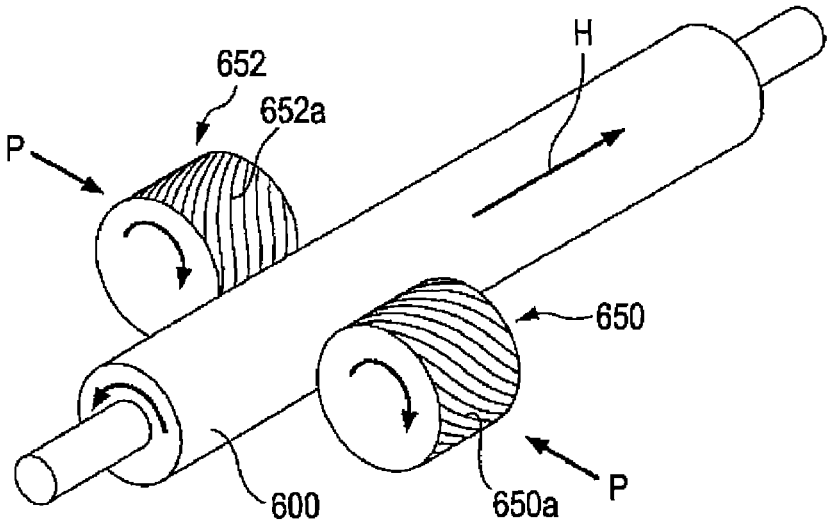
FIG. 20 is a diagram that schematically illustrates an example of the component-rolling process, which constitutes a manufacturing step performed during the production of the development roller 510 according to an exemplary embodiment of the invention.

Next, the width L1 of each of the convex portions 512 and the width L2 of the non-convex portion 513 are determined on the basis of the determined volume mean diameter Ave of the toner T used by the printer 10 according to the present embodiment of the invention. The width L1 of each of the convex portions 512 and the width L2 of the non-convex portion 513 depend largely on the amount of the toner T that is to be carried by the development roller 510. It should be noted that the amount of the toner T that is carried in the non-convex portion 513 is larger than the amount of the toner T that is carried on the convex portions 512. For this reason, from the viewpoint of achieving a larger amount of the toner t that is carried by the development roller 510, it is preferable that the width L2 of the non-convex portion 513 should be relatively large. On the other hand, there are some restrictions in the width L1 of each of the convex portions 512 and the width L2 of the non-convex portion 513 in order to ensure easy work (i.e., manufacture) in a component-rolling process, which is illustrated in FIG. 20 and will be described later. In order to balance these conflicting requirements, in the configuration of the development roller 510 according to the present embodiment of the invention, as illustrated in FIG. 14, the width L1 of each of the convex portions 512 is determined to be approximately 50 μm, whereas the width L2 of the non-convex portion 513 is also determined to be approximately 50 μm.

Finally, the depth d of the concave portion 515 is determined. As the width L1 of each of the convex portions 512 and the width L2 of the non-convex portion 513 depend largely on the amount of the toner T that is to be carried by the development roller 510, so does the depth d of the concave portion 515. That is, it is necessary to determine the depth d of the concave portion 515 at a relatively large value so as to increase the amount of the toner T that is to be carried by the development roller 510. When the depth d of the concave portion 515 is determined, it is necessary to take the area size of the convex portions 512 and the area size of the non-convex portion 513 into consideration.

For the purpose of explanation, it is assumed here that one layer of toner has to be carried on the surface of the development roller 510 in a uniform manner when developing a latent image corresponding to a "solid" (i.e., uniform paint) image. Specifically, it is assumed here that it is necessary for the surface of the middle roller body portion 510*a* of the development roller 510 shown in FIG. 6 to carry one uniform layer of toner so as to develop a solid latent image. In the following explanation, a partial area of the middle roller body portion 510*a* of the development roller 510, which is illustrated in FIG. 14, is taken as an example. The partial area thereof illustrated in FIG. 14 is a square-shaped region having the length of 200 μm on each side thereof. In order to develop a latent image corresponding to the above-described uniform paint image, it is necessary for the square-shaped region to carry one layer of toner in a uniform manner. As has already been explained earlier, the distance g that is measured from the tip 560*b* of the toner-layer-thickness controlling blade 560 to the currently facing convex portions 512 of the rotating development roller 510, which is approximately 2 μm, is smaller than the volume mean diameter Ave of particles of the toner T that is used by the printer 10 according to the present embodiment of the invention, which is approximately 3 μm. For this reason, at the time when the "our-attention-focused" or illustrated (i.e., currently facing) convex portions 512 (refer to FIG. 9), among all thereof, reach the facing position so as to face the toner-layer-thickness controlling blade 560 as the development roller 510 rotates, the toner T that was carried on these convex portions 512 prior to the toner-layer thickness control that is performed by the toner-layer-thickness controlling blade 560 cannot pass through a smaller clearance between the tip 560*b* of the toner-layer-thickness controlling blade 560 and the opposite region 512*a* of these currently facing convex portions 512 of the rotating development roller 510, to which our focus of attention is directed in this explanation. Thus, it follows that no toner T is carried on the convex portions 512 after the completion of the toner-layer thickness control that is performed by the toner-layer-thickness controlling blade 560. In contrast thereto, the toner T that was carried in the non-convex portion 513 prior to the toner-layer thickness control that is performed by the toner-layer-thickness controlling blade 560 can pass through the clearance between the tip 560*b* of the toner-layer-thickness controlling blade 560 and the opposite region 512*a* of these currently facing convex portions 512 of the rotating development roller 510. This means that, even after the completion of the toner-layer thickness control, the toner T remains carried in the non-convex portion 513.

Accordingly, in order to develop a latent image corresponding to the above-described solid image, it is necessary to make up for a deficient amount of the toner T that is actually not carried on the convex portions 512 after the completion of the toner-layer thickness control performed by the toner-layer-thickness controlling blade 560 by a sufficient amount of the toner T that remains carried in the non-convex portion 513 even after the completion of the toner-layer thickness control performed by the toner-layer-thickness controlling blade 560. In order to ensure that a sufficient amount of the toner T remains carried in the non-convex portion 513 even after the completion of the toner-layer thickness control, which is ample enough to compensate such a deficiency, the depth d of the concave portion 515 is determined at a sufficiently large value. Therefore, the depth d of the concave portion 515 is determined as a value that is calculated as the result of multiplication of the volume mean diameter Ave of particles of the toner T that is used by the printer 10 according to the present embodiment of the invention by (the area size of the convex portions 512+the area size of the non-convex portion 513)/the area size of the non-convex portion 513. In the illustrated example of FIG. 14, the width L1 of each of the convex portions 512 is approximately 50 μm, whereas the width L2 of the non-convex portion 513 is also approximately 50 μm. Accordingly, (the area size of the convex portions 512+the area size of the non-convex portion 513)/the area size of the non-convex portion 513 equals 4/3. Therefore, the required depth d of the concave portion 515 is determined to be 4 μm. As explained above, the depth d of the concave portion 515 is determined on the basis of the area size of the convex portions 512 and the area size of the non-convex portion 513.

In the configuration of the printer 10 (or more specifically, the development roller 510 thereof) according to the present embodiment of the invention, it is intended that one layer or more of toner T that is carried in the concave portion 515 thereof remains unused for development after the completion thereof. Specifically, it is intended in the present embodiment of the invention that, immediately after that the development roller 510 has developed a latent image, which is carried on the photosensitive member 20, by means of a toner carried in the concave portion 515 thereof in response to the application of a development bias thereto (i.e., to the development roller 510) by the development bias application unit 121, at least one layer of toner remains carried in the concave portion 515 thereof. For this reason, it is necessary to set the depth d of the concave portion 515 at a value that is larger than the value calculated in accordance with the above-defined mathematical formula (4 μm) by the thickness of at least one layer of toner T. That is, it is necessary to set the depth d of the concave portion 515 at a value that is not smaller than a value obtained as the result of the addition of the value calculated in accordance with the above mathematical formula (4 μm) to the volume mean diameter Ave of particles of the toner T (3 μm), which is 7 μm. Moreover, with due consideration given to the fact that the per-area amount of the toner T that is carried on the side portions 514 is relatively small in comparison with the per-area amount of the toner T that is carried in the concave portion 515 because each of the side portions 514 of the non-convex portion 513 is formed as a slope, the depth d of the concave portion 515 is set at 8 μm. By this means, it is possible to prevent any deficiency in the amount of toner T that is actually used for development even though (at least) one layer of the toner T that is in contact with the concave portion 515 remains carried thereon without being used for the development after the completion thereof.

Technical Usefulness of Printer 10 According to Present Embodiment of the Invention As has already been described above, immediately after that the development roller 510 has developed a latent image, which is carried on the photosensitive member 20, by means of a toner carried in the concave portion 515 thereof in response to the application of a development bias thereto (i.e., to the development roller 510) by the development bias application unit 121, at least one layer of toner remains carried in the concave portion 515 thereof in the configuration of the printer 10 according to the present embodiment of the invention. Such a configuration makes it possible to prevent any electric discharge from occurring between the concave portion 515 and the photosensitive member 20 immediately after the completion of development. In the following description, it is explained in detail how the printer 10 according to the present embodiment of the invention prevents any electric discharge from occurring between the concave portion 515 and the photosensitive member 20 thereof immediately after the completion of development.

Figure 15A:
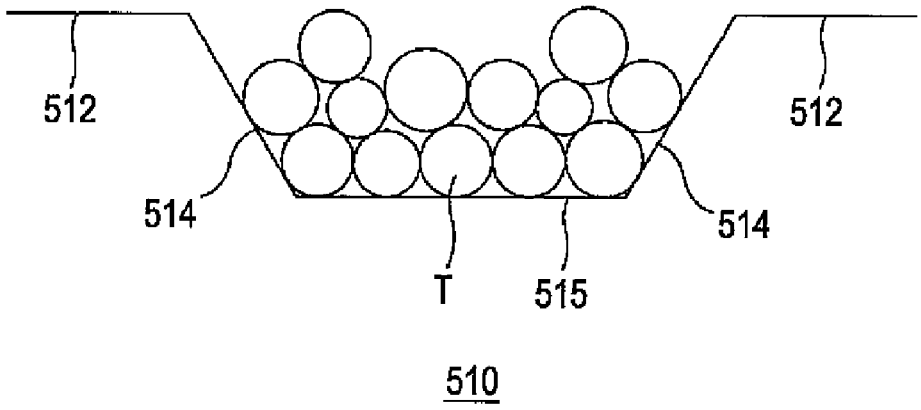
FIGS. 15A and 15B is a set of explanatory diagrams that schematically illustrates the technical usefulness of the printer 10 according to an exemplary embodiment of the invention; or more specifically.

As has already been described above in Related Art of this specification, before the development of a latent image, toner T that is carried by the development roller 510 covers the concave portion 515, which means that the concave portion 515 is not exposed. This covered state of the concave portion 515 is illustrated in FIG. 15A. On the other hand, immediately after the completion of development of a latent image that is carried by the photosensitive member 20 by means of the toner T that is carried in the concave portion 515 formed in the circumferential surface of the development roller 510, which is performed at the development position, there is a possibility that the concave portion 515 becomes exposed because the toner T may not cover the concave portion 515 immediately after the completion of development thereof. Or, in other words, in some cases, the concave portion 515 might become exposed immediately after the movement of the toner T, which was carried in the concave portion 515 (made of metal) thereof, onto the photosensitive member 20. If the development bias application unit 121 continues the application of a development bias to the development roller 510 even under the conditions that the concave portion 515 thereof has become exposed, there is an adverse possibility that electric discharge occurs between the exposed concave portion 515 thereof and the photosensitive member 20 due to the continuously applied development bias. More specifically, if the application of the development bias to the development roller 510 is continued even under the above-described conditions, there is an adverse possibility that electric discharge occurs between the exposed concave portion 515 thereof that has passed through the development position and the photosensitive layer formed on the outer circumferential surface of the cylindrical conductive base substrate of the photosensitive member 20 due to the continuously applied development bias.

Figure 15B:
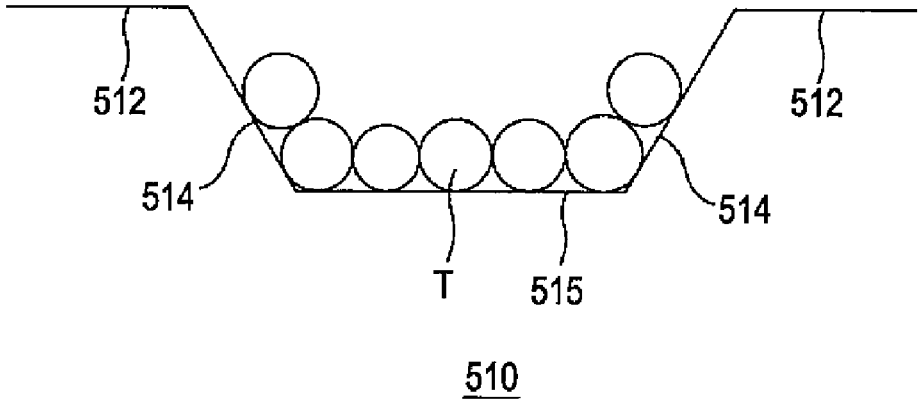

In contrast thereto, the printer 10 according to the present embodiment of the invention prevents any electric discharge from occurring between the concave portion 515 and the photosensitive member 20 thereof immediately after the completion of development. Specifically, in the configuration of the printer 10 according to the present embodiment of the invention, immediately after that the development roller 510 has developed a latent image, which is carried on the photosensitive member 20, by means of a toner carried in the concave portion 515 thereof in response to the application of a development bias thereto (i.e., to the development roller 510) by the development bias application unit 121, at least one layer of toner T remains carried in the concave portion 515 thereof. Or, in other words, immediately after that the concave portion 515 of the development roller 510 has passed through the development position, at least one layer of toner T remains carried in the concave portion 515 thereof. This toner-remaining (i.e., and thus covered) state of the concave portion 515 is illustrated in FIG. 15B. With the advantageous configuration of the printer 10 according to the present embodiment of the invention, the toner T that had covered the concave portion 515 of the development roller 510 before the concave portion 515 thereof reached the development position remains carried thereon to cover the concave portion 515 thereof even after the concave portion 515 thereof has passed through the development position. Since the toner T is an insulating material, the toner T that covers the concave portion 515 prevents any electric discharge that could otherwise occur between the concave portion 515 and the photosensitive member 20 immediately after the passage through the development position.

Note that each of FIGS. 15A and 15B is an explanatory diagram that schematically illustrates the technical usefulness of the printer 10 according to the present embodiment of the invention. Specifically, FIG. 15A illustrates the state of the concave portion 515 before it reaches the development position, whereas FIG. 15B illustrates the state of the concave portion 515 after it has passed through the development position.

Technical Measures for Facilitating That One or More Layer of Toner Remains Carried in Concave Portion 515 Immediately After Completion of Development In the following description, an explanation is given of technical measures for facilitating that at least one layer of toner T remains carried in the concave portion 515 immediately after the completion of development, or, in other words, immediately after that the concave portion 515 has passed through the development position. There are three technical measures for facilitating that one or more layer of toner T remains carried in the concave portion 515 immediately after the completion of development, which are directed to: (1) removal of the toner T by the toner-supplying roller 550, (2) determination of the particle size of the toner T, and (3) determination of the level of a development bias. Any one of these three technical measures could be adopted as a single individual solution so as to achieve the intended technical effects, that is, the continued carrying of at least one layer of the toner T in the concave portion 515 immediately after the completion of development. However, it is preferable to adopt not just one but all three of these technical measures in combination with one another so as to achieve the intended technical effects with the maximum reliability. Accordingly, in the configuration of the printer 10 according to the present embodiment of the invention, all three of these technical measures are adopted in combination with one another. In the following description, each of these three technical measures for facilitating that one or more layer of the toner T remains carried in the concave portion 515 immediately after the completion of development is explained in detail.

(1) Technical Measures Pertinent to Removal of Toner by Toner-supplying Roller 550

As has already been described above, the toner-supplying roller 550 removes residue toner T that remains on the circumferential surface of the development roller 510 after the completion of development therefrom (i.e., from the circumferential surface of the development roller 510). Specifically, the aforementioned wall region 550*b* (shown as the hatched region in FIG. 13), which surrounds each of the aforementioned pores 550*a* formed in the circumferential surface of the toner-supplying roller 550, becomes in contact with the development roller 510 so as to remove the residue toner T therefrom.

In the configuration of the printer 10 according to the present embodiment of the invention, the wall region 550*b* formed in the circumferential surface of the toner-supplying roller 550 removes the residue toner T carried in the non-convex portion 513 thereof while leaving (at least) the lowest-layer toner T that is in contact with the concave portion 515 thereof. In order to ensure that the wall region 550*b* formed in the circumferential surface of the toner-supplying roller 550 removes the residue toner T carried in the non-convex portion 513 thereof while leaving the lowest-layer toner T that is in contact with the concave portion 515 thereof, there are unique dimensional relationships among the pores 550*a* of the toner-supplying roller 550, the wall region 550*b* of the toner-supplying roller 550, the convex portions 512 of the development roller 510, and the non-convex portion 513 of the development roller 510, which will be described in detail below.

Figure 16A:
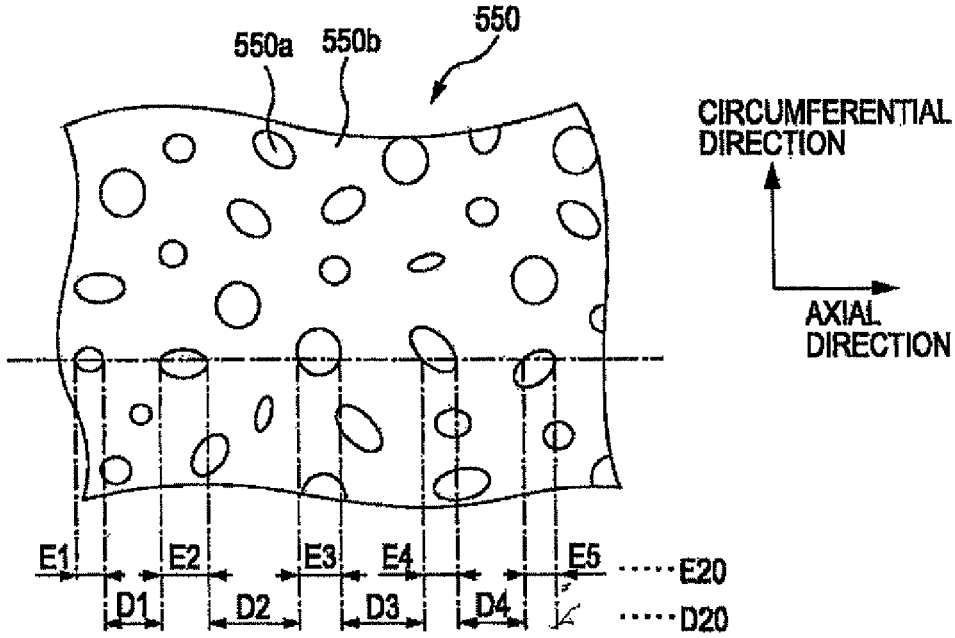
FIG. 16A is an explanatory diagram that schematically illustrates the average distance Dave between one pore 550*a* and another pore 550*a* adjacent thereto, which is measured along the rotation-axis direction of the toner-supplying roller 550 according to an exemplary embodiment of the invention.
Figure 16B:
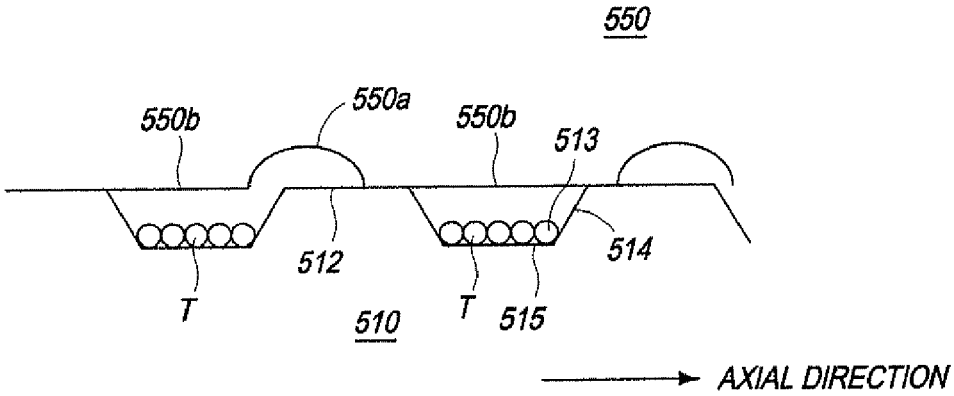
FIG. 16B is an explanatory diagram that schematically illustrates a contact state where the wall region 550*b* of the toner-supplying roller 550 according to an exemplary embodiment of the invention is in contact with the convex portions 512 of the development roller 510 according to an exemplary embodiment of the invention at the contact position.

First of all, an explanation is given below of the relationships between the inter-pore distance, which is the distance between one pore 550*a* and another pore 550*a* adjacent thereto, and the inter-convex-portion distance, which is the distance between one convex portion 512 and another convex portion 512 adjacent thereto. It should be noted that the distance between one convex portion 512 and another convex portion 512 adjacent thereto (i.e., two convex portions 512 adjacent to each other) is equivalent to the width of the non-convex portion 513. In the configuration of the printer 10 according to the present embodiment of the invention, the maximum value of the distance between one convex portion 512 and another convex portion 512 adjacent thereto (i.e., two convex portions 512 adjacent to each other), or, in other words, the maximum value of the width of the non-convex portion 513, is smaller than the average distance between one pore 550*a* and another pore 550*a* adjacent thereto. With reference to FIGS. 16A and 16B, the above-described relationships between the inter-pore distance and the inter-convex-portion distance are explained below. FIG. 16A is an explanatory diagram that schematically illustrates the average distance Dave between one pore 550*a* and another pore 550*a* adjacent thereto according to an exemplary embodiment of the invention. FIG. 16B is an explanatory diagram that schematically illustrates a contact state where the wall region 550*b* of the toner-supplying roller 550 according to an exemplary embodiment of the invention is in contact with the convex portions 512 of the development roller 510 according to an exemplary embodiment of the invention at the contact position.

FIG. 16A schematically shows an enlarged view of the surface of the toner-supplying roller 550 according to an exemplary embodiment of the invention, as in FIG. 13. In FIG. 16A, examples of the inter-pore distances, that is, the distance between one pore 550*a* and another pore 550*a* adjacent thereto, are denoted as D1, D2, D3, and D4. The average distance Dave between one pore 550*a* and another pore 550*a* adjacent thereto is the average value of a plurality of (e.g., twenty of) the inter-pore distances D1, D2, . . . , D20. In the configuration of the toner-supplying roller 550 according to the present embodiment of the invention, the average distance Dave between one pore 550*a* and another pore 550*a* adjacent thereto is set as approximately 80 μm. Herein, it should be noted that each of the inter-pore distances D1, D2, . . . is a distance measured along the rotation-axis direction of the toner-supplying roller 550.

On the other hand, the distance between one convex portion 512 and another convex portion 512 adjacent thereto varies depending on the direction of measurement thereof as understood from FIG. 7. When it is measured in the X direction (or Y direction) shown in FIG. 7, the distance between one convex portion 512 and another convex portion 512 adjacent thereto equals the width L2 of the non-convex portion 513 shown therein, which is approximately 50 μm. On the other hand, when it is measured in the rotation-axis direction (or circumferential direction) of the development roller 510 shown in FIG. 7, the distance between one convex portion 512 and another convex portion 512 adjacent thereto is approximately 70 μm. Accordingly, the distance between one convex portion 512 and another convex portion 512 adjacent thereto takes the maximum distance value when measured along the rotation-axis direction (or circumferential direction) of the development roller 510, which is approximately 70 μm. Therefore, the maximum value of the distance between one convex portion 512 and another convex portion 512 adjacent thereto (i.e., approximately 70 μm) is smaller than the average distance Dave between one pore 550*a* and another pore 550*a* adjacent thereto (i.e., approximately 80 μm).

On the condition that the maximum value of the distance between one convex portion 512 and another convex portion 512 adjacent thereto is smaller than the average distance Dave between one pore 550*a* and another pore 550*a* adjacent thereto, which is the configuration (or, in other words, technical measures) adopted by the printer 10 according to the present embodiment of the invention, as illustrated in FIG. 16B, when the contact region of the toner-supplying roller 550 contacts the development roller 510, the wall region 550*b* of the toner-supplying roller 550 formed between the pores 550*a* thereof adjacent to each other becomes in contact with the convex portion 512 of the development roller 510. Since the maximum value of the distance between one convex portion 512 and another convex portion 512 adjacent thereto is smaller than the average distance Dave between one pore 550*a* and another pore 550*a* adjacent thereto, except for exceptional ones, each wall region 550*b* of the toner-supplying roller 550 formed between the pores 550*a* thereof adjacent to each other does not get into the non-convex portion 513 (i.e., the side portions 514 and the concave portion 515) of the development roller 510. For this reason, it is possible to significantly reduce the possibility of the undesirable removal of the lowest-layer toner T that is in contact with the concave portion 515 thereof. Then, the remaining toner T of one layer or more, which includes, at least, the lowest-layer one that is (or, in other words, "was") in contact with the concave portion 515 thereof, continues to be carried in the concave portion 515 thereof. As a result thereof, the remaining toner T is further electrified. By this means, it becomes harder for the remaining toner T of one layer or more to move to the photosensitive member 20 at the time of development. Consequently, even immediately after that the concave portion 515 has passed through the development position, the lowest-layer toner T that is in contact with the concave portion 515 thereof is most likely to remain carried therein.

Figure 17:
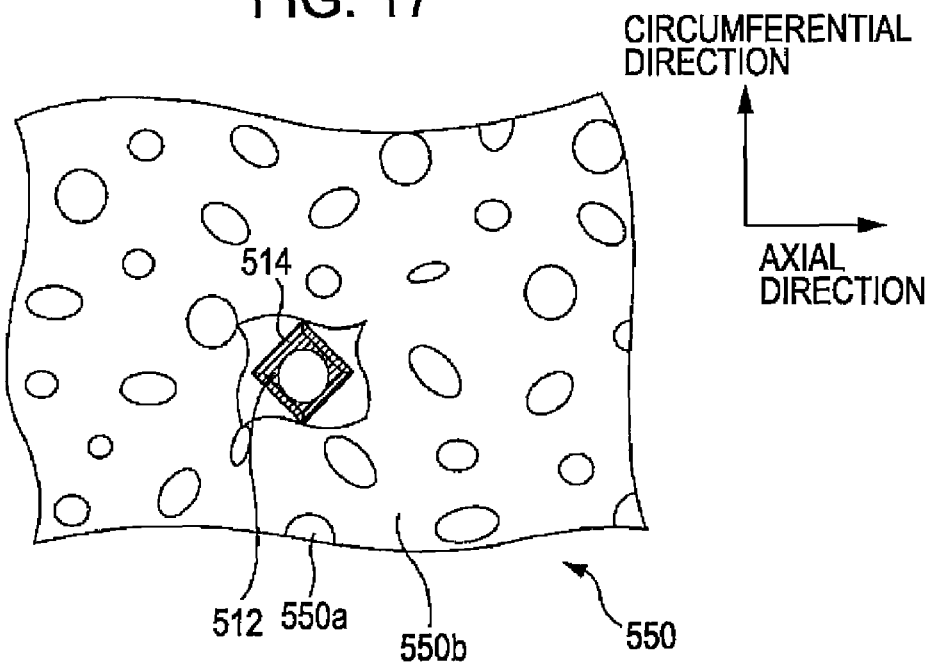
FIG. 17 is an explanatory diagram that schematically illustrates the relationships between the widths of the non-concave portions (i.e., the convex portions 512 and the side portions 514) and the opening widths of the pores 550*a* according to an exemplary embodiment of the invention.

Next, an explanation is given below of the relationships between the opening widths of the pores 550*a* and the widths of the non-concave portions (i.e., the convex portions 512 and the side portions 514). In the configuration of the printer 10 according to the present embodiment of the invention, the maximum value of the widths of the non-concave portions is larger than the average opening width of the pores 550*a*. With reference to FIGS. 16A and 17, the above-described relationships between the maximum value of the widths of the non-concave portions and the average opening width of the pores 550*a* are explained below. FIG. 17 is an explanatory diagram that schematically illustrates the relationships between the widths of the non-concave portions (i.e., the convex portions 512 and the side portions 514) and the opening widths of the pores 550*a* according to an exemplary embodiment of the invention. It should be noted that only one non-concave portion is illustrated in FIG. 17 in order to simplify explanation.

In FIG. 16A, examples of the opening widths of the pores 550*a* are denoted as E1, E2, E3, E4, and E5. The average opening width Eave of the pores 550*a* is the average value of a plurality of (e.g., twenty of) the opening widths of the pores 550*a* E1, E2, . . . , E20. In the configuration of the toner-supplying roller 550 according to the present embodiment of the invention, the average opening width Eave of the pores 550*a* is set as approximately 40 μm. On the other hand, as the distance between one convex portion 512 and another convex portion 512 adjacent thereto varies depending on the direction of measurement thereof, so does the width of the non-concave portion (i.e., the convex portion 512 and the side portions 514), which will be understood by making reference to FIG. 7. The width of the non-concave portion takes the maximum width value when measured along the rotation-axis direction (or circumferential direction) of the development roller 510, which is approximately 93 μm. Therefore, the maximum value of the widths of the non-concave portions (93 μm) is larger than the average opening width Eave of the pores 550*a*, which is approximately 40 μm.

On the condition that the maximum value of the widths of the non-concave portions is larger than the average opening width Eave of the pores 550*a*, which is the configuration (or, in other words, technical measures) adopted by the printer 10 according to the present embodiment of the invention, as illustrated in FIG. 17, except for exceptional ones, the pore 550*a* does not completely cover the convex portion 512 and the side portions 514. In FIG. 17, a region of the convex portion 512 and the side portions 514 that is not covered by the pore 550*a* is shown as a hatched area. Since the maximum value of the widths of the non-concave portions is larger than the average opening width Eave of the pores 550*a*, when the contact region of the toner-supplying roller 550 contacts the development roller 510, each wall region 550*b* of the toner-supplying roller 550 formed between the pores 550*a* thereof adjacent to each other does not get into the non-convex portion 513 deeply so as to become in contact with the concave portion 515 of the development roller 510. For this reason, it is possible to significantly reduce the possibility of the undesirable removal of the lowest-layer toner T that is in contact with the concave portion 515 thereof. Then, the remaining toner T of one layer or more, which includes, at least, the lowest-layer one that is (or, in other words, "was") in contact with the concave portion 515 thereof, continues to be carried in the concave portion 515 thereof. As a result thereof, the remaining toner T is further electrified. By this means, it becomes harder for the remaining toner T of one layer or more to move to the photosensitive member 20 at the time of development. Consequently, even immediately after that the concave portion 515 has passed through the development position, the lowest-layer toner T that is in contact with the concave portion 515 thereof is most likely to remain carried therein.

As has already been described above, the distance from the convex portions 512 to the concave portion 515 that is measured in the radial direction of the development roller 510, which is the depth d of the concave portion 515 (i.e., the depth d of the non-convex portion 513) that is shown in the lower-part drawing of FIG. 7, is approximately 8 μm. Or, in other words, the height of the non-concave portion (i.e., the convex portion 512 and the side portions 514), which is measured from the concave portion (i.e., bottom) 515, is approximately 8 μm. On the condition that the maximum value of the heights (i.e., maximum height) of the non-concave portions is larger than the average opening depth of the pores 550*a*, which can be adopted by the printer 10 according to the present embodiment of the invention, it is possible to significantly reduce the possibility that the wall region 550*b* of the toner-supplying roller 550 formed between the pores 550*a* thereof adjacent to each other undesirably removes the lowest-layer toner T that is in contact with the concave portion 515 thereof, except for exceptional ones. If the maximum value of the heights of the non-concave portions is larger than the average opening depth of the pores 550*a*, the pore 550*a* does not completely cover the non-concave portion, except for exceptional ones. Therefore, each wall region 550*b* of the toner-supplying roller 550 formed between the pores 550*a* thereof adjacent to each other does not get into the non-convex portion 513 deeply so as to become in contact with the concave portion 515 of the development roller 510. For this reason, it is possible to significantly reduce the possibility of the undesirable removal of the lowest-layer toner T that is in contact with the concave portion 515 thereof. For this reason, it is preferable that the average opening depth of the pores 550*a* should be smaller than 8 μm.

(2) Technical Measures Pertinent to Determination of Particle Size of Toner T

Figure 18:
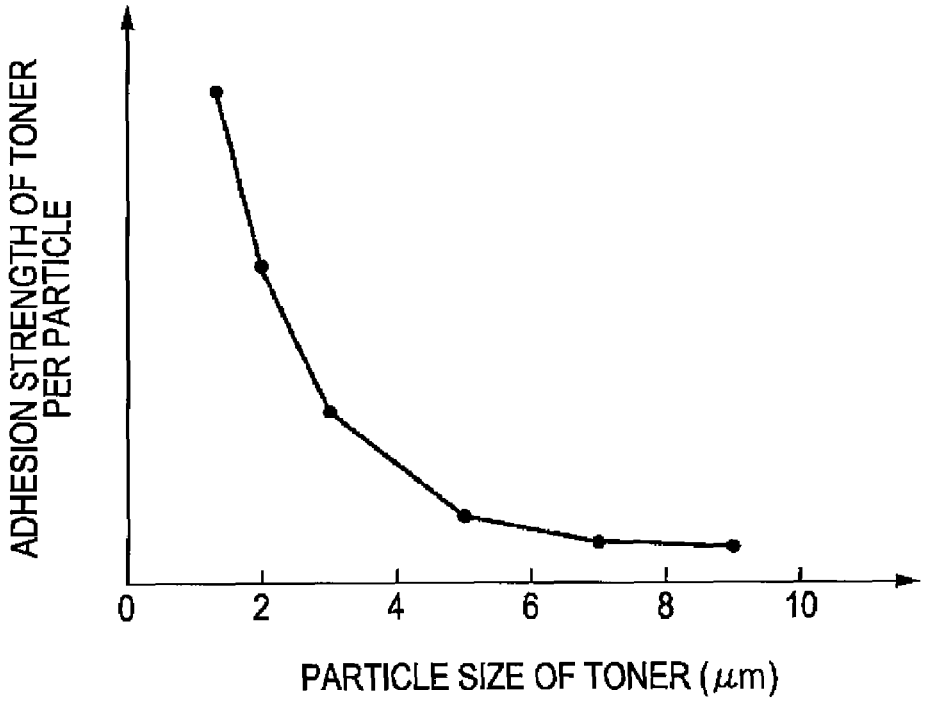
FIG. 18 is a graph that shows the relationship between the particle size of toner and the adhesion strength of the toner to the circumferential surface of the development roller 510 based on Van der Waals force.

It is known in the art that there is a certain relation between the particle size of toner T and the strength of adhesion thereof to the circumferential surface of the development roller 510 based on Van der Waals force. Specifically, as shown in FIG. 11, the adhesion strength of toner T to the circumferential surface of the development roller 510 based on Van der Waals force does not change so much in accordance with a change in the particle size of the toner T if the particle size of the toner T is large, or more specifically, larger than 5 μm. In contrast, the adhesion strength of the toner T to the circumferential surface of the development roller 510 based on Van der Waals force changes significantly in accordance with a change in the particle size of the toner T if the particle size of the toner T is small, or more specifically, not larger than 5 μm. In a case where the particle size of the toner T is not larger than 5 μm, the adhesion strength of the toner T to the circumferential surface of the development roller 510 based on Van der Waals force increases as the particle size of the toner T becomes smaller. FIG. 18 is a graph that shows the relationship between the particle size of the toner T and the adhesion strength of the toner T to the circumferential surface of the development roller 510 based on Van der Waals force. The horizontal axis of the graph shown in FIG. 18 represents the particle size of the toner T, whereas the vertical axis of the graph shown in FIG. 18 represents the adhesion strength of the toner T to the circumferential surface of the development roller 510 based on Van der Waals force.

As has already been described earlier, the volume mean diameter (i.e., average particle size) of the toner T according to the present embodiment of the invention is approximately 3 μm. Accordingly, as shown in FIG. 18, the strength of the adhesion of the toner T that is used by the printer 10 according to the present embodiment of the invention to the circumferential surface of the development roller 510 based on Van der Waals force is large. Because of such a large strength of the adhesion of the toner T to the circumferential surface of the development roller 510 based on Van der Waals force, in the configuration of the printer 10 according to the present embodiment of the invention, the lowest-layer toner T (though not limited thereto) that is in contact with the concave portion 515 of the development roller 510 remains carried in the concave portion 515 thereof and does not move to the photosensitive member 20 even at the time when the concave portion 515 thereof that carries the toner T comes to the development position in the course of the development of a latent image formed on the photosensitive member 20. Therefore, (at least).the lowest-layer toner T that is in contact with the concave portion 515 of the development roller 510 remains carried in the concave portion 515 thereof even immediately after the completion of development. As explained above, on the condition that the particle size of the toner T is not larger than 5 μm, which is the technical measures adopted by the printer 10 according to the present embodiment of the invention, it is possible to achieve the continued carrying of at least one layer of the toner T in the concave portion 515 of the development roller 510 even immediately after that the concave portion 515 thereof has passed through the development position.

(3) Technical Measures Pertinent to Determination of Level of Development Bias

As has already been described earlier, the development bias application unit 121 (refer to FIG. 2) applies a development bias to the development roller 510. The development bias is a DC-AC superposed voltage that is formed by superposing an alternating voltage onto a direct-current voltage. As a result of the application of a development bias to the development roller 510 by the development bias application unit 121, an electric field is generated between the photosensitive member 20 and the development roller 510. Because of the generation of the electric field, the toner T moves from the development roller 510 to the photosensitive member 20.

In the configuration of the printer 10 according to the present embodiment of the invention, the development bias is set at a level that does not cause the movement of the lowest-layer toner T, though not limited thereto, which is in contact with the concave portion 515 of the development roller 510 therefrom to the photosensitive member 20. Or, in other words, the development bias is set at such a level that, even at the time when the concave portion 515 of the development roller 510 arrives at the development position, the lowest-layer toner T that is in contact with the concave portion 515 thereof never moves to the photosensitive member 20 whereas other toner T that is carried in the non-convex portion 513 thereof (which excludes, at least, the lowest-layer toner T) moves to the photosensitive member 20 due to the generated electric field and thus is used for the development of a latent image formed on the photosensitive member 20. As explained above, on the condition that the development bias is set at a level that does not cause the movement of the lowest-layer toner T, though not limited thereto, which is in contact with the concave portion 515 of the development roller 510 therefrom to the photosensitive member 20, which is the technical measures adopted by the printer 10 according to the present embodiment of the invention, it is possible to achieve the continued carrying of at least one layer of the toner T in the concave portion 515 of the development roller 510 even immediately after that the concave portion 515 thereof has passed through the development position.

In the foregoing description of this specification, our focus of attention is directed to the problem of an electric discharge that occurs between the exposed concave portion 515 of the development roller 510 that has passed through the development position and (the photosensitive layer formed on the outer circumferential surface of the cylindrical conductive base substrate of) the photosensitive member 20 (due to the continuously applied development bias). However, the occurrence of an electric discharge is not limited to a region between the exposed concave portion 515 thereof and the photosensitive member 20. That is, an electric discharge could also occur at a region between the convex portions 512 thereof and the photosensitive member 20. Notwithstanding the above-described fact, however, the printer 10 according to the present embodiment of the invention is not designed to carry at least one layer of toner T on the convex portions 512 of the development roller 510 after (and also before) the completion of development. That is, in order to place a greater importance on image quality than electric-discharge reduction, it is intended that the convex portions 512 thereof carry no single layer of the toner T immediately after (and also before) the completion of development in the configuration of the printer 10 according to the present embodiment of the invention. Although detailed explanation thereof is omitted herein, image quality will be degraded if development is performed with the toner T being carried also on the convex portions 512 thereof because, if so configured, a development memory problem will arise in a conspicuous manner. To sum up, the printer 10 according to the present embodiment of the invention carries almost no toner T on the convex portions 512 of the development roller 510 thereof immediately before the completion of development. For this reason, almost no toner T is carried thereon immediately after the completion of development.

Method for Manufacturing Development Apparatus

Figure 21:
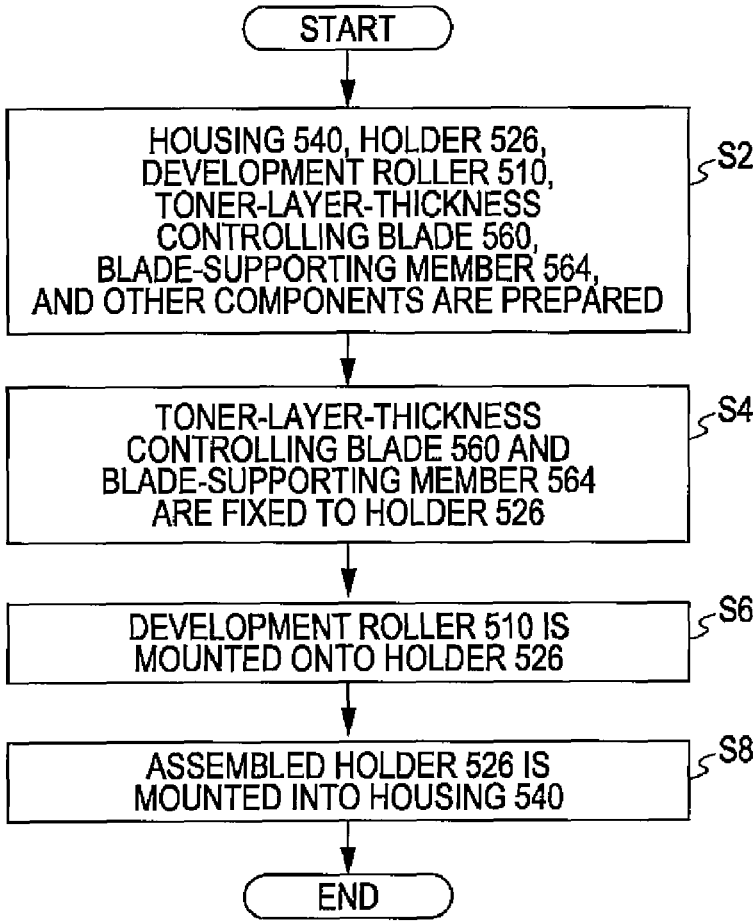
FIG. 21 is a flowchart that illustrates an example of the assembly procedure of the yellow development apparatus 54 according to an exemplary embodiment of the invention.

Next, with reference to FIGS. 19A, 19B, 19C, 19D, 19E, 20, and 21, a method for manufacturing a development apparatus according to an exemplary embodiment of the invention is explained below. FIGS. 19A, 19B, 19C, 19D, and 19E are a set of diagrams that schematically illustrates an example of the in-process development roller 510 (or, in other words, the manufacturing of the development roller 510 on a step-by-step basis) according to an exemplary embodiment of the invention. FIG. 20 is a diagram that schematically illustrates an example of the component-rolling process, which constitutes a manufacturing step performed during the production of the development roller 510 according to an exemplary embodiment of the invention. FIG. 21 is a flowchart that illustrates an example of the assembly procedure of the yellow development apparatus 54 according to an exemplary embodiment of the invention. In the manufacturing of a development apparatus according to an exemplary embodiment of the invention, after the individual production of the aforementioned housing 540, holder 526, development roller 510, toner-supplying roller 550, toner-layer-thickness controlling blade 560, and other components/members, these components/members are assembled together so as to make up a development apparatus according to an exemplary embodiment of the invention. In this part of the specification, first of all, a method for the production of the development roller 510, among these components/members, is explained below, which is followed by an explanation of a method for the production of a development apparatus according to an exemplary embodiment of the invention. In the following description, the yellow development apparatus 54 is taken as an example for explaining a method for the manufacturing of a development apparatus according to an exemplary embodiment of the invention.

Method for Manufacturing Development Roller 510

Now with reference to FIGS. 19A, 19B, 19C, 19D, 19E, and 20, a method for manufacturing the development roller 510 according to an exemplary embodiment of the invention is explained below.

Figure 19A:
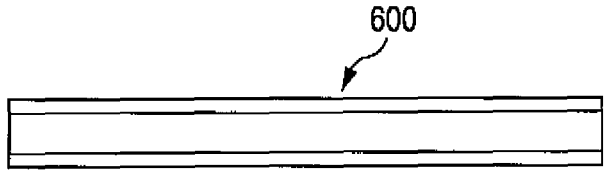
FIGS. 19A, 19B, 19C, 19D, and 19E are a set of diagrams that schematically illustrates an example of the in-process development roller 510 according to an exemplary embodiment of the invention.
Figure 19B:
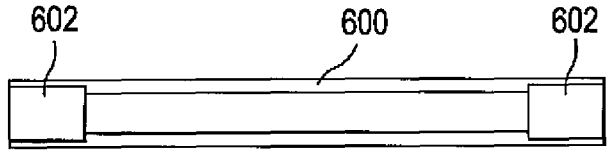
Figure 19C:
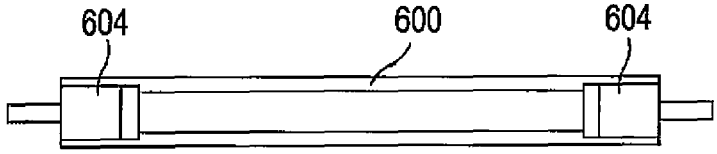
Figure 19D:
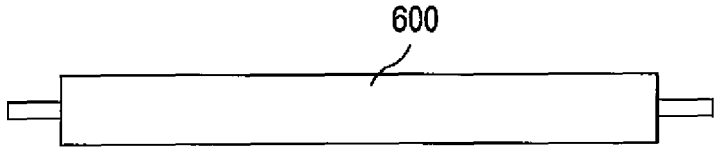
Figure 19E:
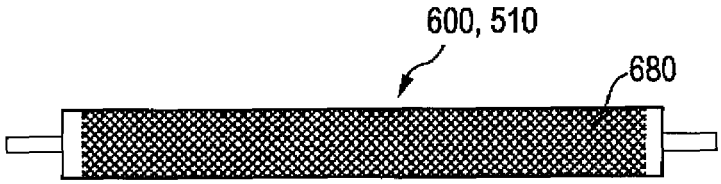

As a first step thereof, as illustrated in FIG. 19A, a pipe material 600, which constitutes the base substance member of the development roller 510 according to an exemplary embodiment of the invention, is prepared. The wall thickness of the pipe material member 600 is in a range from 0.5 mm to 3 mm. As a next step, as illustrated in FIG. 19B, a flange press-fit portion 602 is formed at each edge of the pipe material member 600, which has an elongated space, viewed along the long-side direction thereof. These flange press-fit portions 602 are formed at both edges of the elongated pipe material member 600 by machining, or, in other words, cutting work. As a next step, as illustrated in FIG. 19C, a flange 604 is pressed into each of the flange press-fit portions 602. In order to secure the fixation of these flanges 604 to the flange press-fit portions 602 of the pipe material member 600, each of the flanges 604 may be adhered or welded to the flange press-fit portions 602 of the pipe material member 600 after being pressed therein. As a next step, as illustrated in FIG. 19D, the circumferential surface of the pipe material member 600 having the flanges 604 press-fitted therein is subjected to center-less polishing (i.e., center-less grinding). The center-less polishing is performed on the entire circumferential surface of the pipe material member 600. After the completion of the center-less polishing, the ten-point medium height (i.e., ten-point average roughness) of the circumferential surface of the pipe material member 600, which is denoted as Rz, is 1.0 μm or smaller. As a next step, as illustrated in FIG. 19E, the circumferential surface of the pipe material member 600 having the flanges 604 press-fitted therein is subjected to component rolling. In a method for manufacturing the development roller 510 according to the present embodiment of the invention, the pipe material member 600 is subjected to a so-called "through-feed component rolling". The through-feed component rolling is performed by means of a pair of rolling cylindrical dies 650 and 652.

As illustrated in FIG. 20, the pair of rolling cylindrical dies 650 and 652 is set so as to pinch the pipe material member 600 therebetween, which (i.e., the pipe material member 600) is the workpiece in this through-feed component rolling process. Each of these rolling cylindrical dies 650 and 652 is urged against the pipe material member 600 with a predetermined urging force (i.e., pressure). The direction of this pressure is shown as P in FIG. 20. Then, these rolling cylindrical dies 650 and 652 are turned in the same rotating direction. The rotating direction of these rolling cylindrical dies 650 and 652 is illustrated by means of a pair of arrows in FIG. 20. In the process of this through-feed component rolling, the rolling cylindrical dies 650 and 652 turn so as to move the pipe material member 600 in a direction denoted as H in FIG. 20. While the pipe material member 600 moves in the direction denoted as H in FIG. 20 as the pair of rolling cylindrical dies 650 and 652 turn in the same rotating direction, the pipe material member 600 turns in the direction that is opposite the above-mentioned rotating direction of the pair of rolling cylindrical dies 650 and 652. These rolling cylindrical dies 650 and 652 have convex portions 650*a* and 652*a* that are formed on the circumferential surfaces thereof, respectively. The convex portions 650*a* and 652*a* of the rolling cylindrical dies 650 and 652 are provided so as to form grooves 680 on the circumferential surface of the pipe material member 600. As the convex portions 650*a* and 652*a* of the rolling cylindrical dies 650 and 652 deform the circumferential surface of the pipe material member 600, the grooves 680 are formed on the circumferential surface of the pipe material member 600.

After the completion of this through-feed component rolling, the surface of the middle roller body portion 510*a* of the development roller 510 is plated. As has already been described earlier, electro-less Ni—P plating is applied to the surface of the middle roller body portion 510*a* of the development roller 510 according to an exemplary embodiment of the invention. However, the scope of the invention is not limited to such an exemplary plating method. For example, hard chrome plating may be used in place of electro-less Ni—P plating. Or, as another non-limiting modification example, electroplating may be used in place of electro-less Ni—P plating.

Method for Assembling Yellow Development Apparatus 54

Next, with reference to FIG. 21, a method for assembling the yellow development apparatus 54 is explained below. As a first step, the aforementioned housing 540, holder 526, development roller 510, toner-layer-thickness controlling blade 560, blade-supporting member 564, and other components/members are prepared (step S2).

As a next step, the toner-layer-thickness controlling blade 560 and the blade-supporting member 564 are fastened to the pair of controlling-blade supporting portions 526*c* of the holder 526 by means of screws. By this means, the toner-layer-thickness controlling blade 560 and the blade-supporting member 564 are fixed to the holder 526 (step S4). It should be noted that the aforementioned pair of end-region sealing members 574 has already been affixed to the toner-layer-thickness controlling blade 560 prior to this step S4.

As a next step (step S6), the development roller 510 is mounted onto the holder 526 to which the toner-layer-thickness controlling blade 560 and the blade-supporting member 564 were attached in the preceding step (step S4). In this step, the development roller 510 is attached to the holder 526 in such a manner that the toner-layer-thickness controlling blade 560 extends from one end region of the development roller 510 as viewed along the rotation axis thereof to the other end region thereof and that the contact region 560*a* of the toner-layer-thickness controlling blade 560 contacts the circumferential surface of the development roller 510. It should be noted that the aforementioned upside sealing member 520 has already been affixed to the holder 526 prior to this step S6.

As a next step, the assembled holder 526 to which the upside sealing member 520, the development roller 510, the toner-layer-thickness controlling blade 560, and the blade-supporting member 564 are attached is mounted into the aforementioned housing 540 with a housing sealant member 546 being interposed therebetween (step S8). In this way, the yellow development apparatus 54 according to an exemplary embodiment of the invention is assembled. It should be noted that the aforementioned toner-supplying roller 550 has already been affixed to the housing 540 prior to this step S8.

Other Embodiments

In the foregoing description, the present invention is explained while discussing some exemplary embodiments of the invention (as well as minor variations/modifications thereof) These specific embodiments (as well as minor variations/modifications thereof) of an image formation apparatus according to the invention described above are provided solely for the purpose of facilitating the understanding of the invention. It should be noted that, in no case, these explanatory embodiments are interpreted to limit the scope of the invention. The invention may be modified, altered, changed, adapted, and/or improved within a range not departing from the gist and/or spirit of the invention apprehended by a person skilled in the art from explicit and implicit description made herein, where such a modification, an alteration, a change, an adaptation, and/or an improvement is also covered by the scope of the appended claims. It is the intention of the inventor/applicant that the scope of the invention covers any equivalents thereof without departing therefrom.

In the foregoing description of exemplary embodiments of the invention, an intermediary-image-transfer-type full-color laser beam printer is taken as an example of an image formation apparatus according to the invention. Notwithstanding the foregoing, the invention can be also applied to various kinds of image formation apparatuses other than intermediary-image-transfer-type ones, including but not limited to, a non-intermediary-image-transfer full-color laser beam printer, a non-intermediary-image-transfer monochrome laser beam printer, a non-intermediary-image-transfer copying machine, and a non-intermediary-image-transfer facsimile machine.

In the foregoing description of exemplary embodiments of the invention, it is explained that the photosensitive member 20 has a photosensitive layer formed on the outer circumferential surface of the cylindrical conductive base substrate, which is a so-called photosensitive roller. However, the configuration of the photosensitive member 20 is not limited to such an example. As a non-limiting modification example thereof, the photosensitive layer of the photosensitive member 20 may be formed on the surface of a belt-shaped conductive base substrate. That is, the photosensitive member 20 may be configured as a so-called photosensitive belt.

In the foregoing description of exemplary embodiments of the invention, it is explained that, as illustrated in FIG. 4, the laser beam printer 10 (image formation apparatus) is provided with the toner-layer-thickness controlling blade 560 that contacts the circumferential surface of the development roller 510 so as to control the layer thickness of the toner T that is carried on the circumferential surface of the development roller 510 and further that the depth d of the concave portion 515 (approximately 8 μm) is smaller than the volume mean particle diameter of the toner T (approximately 3 μm) multiplied by three. However, the scope of the invention is not limited to such an exemplary configuration. For example, the depth d of the concave portion 515 may be larger than the volume mean particle diameter of the toner T multiplied by three. Although it is possible to adopt such a modified configuration, it is more preferable that the depth d of the concave portion 515 should be smaller than the volume mean particle diameter of the toner T multiplied by three as described in the foregoing exemplary embodiments of the invention because the foregoing configuration according to exemplary embodiments of the invention ensures adequate and sufficient electrification of the toner T that is carried in the non-convex portion 513 as explained below. The toner T carried in the non-convex portion 513 of the development roller 510 moves while becoming in contact with the side portions 514 and the concave portion 515 thereof as the development roller 510 rotates. The toner T carried in the non-convex portion 513 becomes electrified in the course of such rotary/rolling movement due to contact with the side portions 514 and the concave portion 515 thereof. The toner T carried in the non-convex portion 513 becomes further electrified in the course of toner-layer thickness control performed by the toner-layer-thickness controlling blade 560 due to contact with the toner-layer-thickness controlling blade 560. In this way, the amount of electrification of the toner T carried in the non-convex portion 513 thereof becomes adequate and sufficient. If the depth d of the concave portion 515 is larger than the volume mean particle diameter of the toner T multiplied by three, the amount of the toner T that does not contact the side portions 514, the concave portion 515, or the toner-layer-thickness controlling blade 560 is relatively large, which means that the amount of the toner T having inadequate and insufficient amount of electrification is relatively large. On the other hand, if the depth d of the concave portion 515 is smaller than the volume mean particle diameter of the toner T multiplied by three, the toner T contacts (at least) either one of the side portions 514, the concave portion 515, and the toner-layer-thickness controlling blade 560, which ensures adequate and sufficient amount of electrification of the toner T carried in the non-convex portion 513 thereof.

In the foregoing description of exemplary embodiments of the invention, it is explained that, as illustrated in FIG. 6, the concave portion 515 is formed as the bottom of two different spiral-pattern groove regions one of which is formed to have an angle of gradient viewed with respect to the circumferential direction of the development roller 510 that differs from another angle of gradient viewed with respect to the circumferential direction of the development roller 510 of the other thereof (the first groove region 516 and the second groove region 518) and further that these two different spiral-pattern groove regions intersect with each other, thereby forming a grid pattern. However, the scope of the invention is not limited to such an exemplary configuration. For example, these two different spiral-pattern groove regions may not be formed in the development roller 510. Although these two different spiral-pattern groove regions may not be formed in the development roller 510, the foregoing configuration according to exemplary embodiments of the invention is more preferable because it is possible to form the concave portions 515 that are arrayed in a regular pattern in an easy manner just by forming the first groove region 516 and the second groove region 518 by means of the above-described component rolling or any other alternative technique/method.

In the foregoing description of exemplary embodiments of the invention, it is explained that the development roller 510 has, on the circumferential surface thereof, a plurality of non-concave portions that are arrayed in a regular pattern, where each of the plurality of non-concave portions has the convex portion 512 and further has the side portions 514 that slope down from the convex portion 512 to the concave portion 515, and the concave portion 515 surrounds each of the plurality of non-concave portions. In addition to the above, it is explained in the foregoing description of exemplary embodiments of the invention that each of the black development apparatus 51, the magenta development apparatus 52, the cyan development apparatus 53, and the yellow development apparatus 54 has the toner-supplying roller 550 having a contact region made of a porous foam material and that the contact region of the toner-supplying roller 550 contacts the circumferential surface of the development roller 510 so as to remove the toner T from the circumferential surface of the development roller 510 after the development of a latent image carried on the photosensitive member 20. In addition to the above, it is explained in the foregoing description of exemplary embodiments of the invention that the maximum value of the distance between one convex portion 512 and another convex portion 512 adjacent thereto among the plurality of convex portions 512 (which is approximately 70 μm) is smaller than the average distance Dave between one pore 550*a* of the contact region and another pore 550*a* thereof adjacent thereto (which is approximately 80 μm). However, the scope of the invention is not limited to such an exemplary configuration. For example, the maximum value of the distance between two convex portions 512 that are adjacent to each other among the plurality of convex portions 512 may be larger than the average distance Dave between two pores 550*a* of the contact region that are adjacent to each other. Although it is possible to adopt such a modified configuration, it is more preferable that the maximum value of the distance between one convex portion 512 and another convex portion 512 adjacent thereto among the plurality of convex portions 512 should be smaller than the average distance Dave between one pore 550*a* of the contact region and another pore 550*a* thereof adjacent thereto as described in the foregoing exemplary embodiments of the invention because the foregoing configuration according to exemplary embodiments of the invention facilitates that at least one layer of toner T remains carried in the concave portion 515 immediately after the completion of development as explained below. On the condition that the maximum value of the distance between one convex portion 512 and another convex portion 512 adjacent thereto is smaller than the average distance Dave between one pore 550*a* and another pore 550*a* adjacent thereto, when the contact region of the toner-supplying roller 550 contacts the development roller 510, the wall region 550*b* of the toner-supplying roller 550 formed between the pores 550*a* thereof adjacent to each other becomes in contact with the convex portion 512 of the development roller 510. Since the maximum value of the distance between one convex portion 512 and another convex portion 512 adjacent thereto is smaller than the average distance Dave between one pore 550*a* and another pore 550*a* adjacent thereto, except for exceptional ones, each wall region 550*b* of the toner-supplying roller 550 formed between the pores 550*a* thereof adjacent to each other does not get into the non-convex portion 513 (i.e., side portions 514 and concave portion 515) of the development roller 510. For this reason, it is possible to significantly reduce the possibility of the undesirable removal of the lowest-layer toner T that is in contact with the concave portion 515 thereof (i.e., one layer or more of the toner T). Then, the remaining toner T of one layer or more, which includes, at least, the lowest-layer one that is in contact with the concave portion 515 thereof, continues to be carried in the concave portion 515 thereof. As a result thereof, the remaining toner T is further electrified. By this means, it becomes harder for the remaining toner T of one layer or more to move to the photosensitive member 20 at the time of development. Consequently, even immediately after that the concave portion 515 has passed through the development position, the lowest-layer toner T that is in contact with the concave portion 515 thereof is most likely to remain carried therein.

In the foregoing description of exemplary embodiments of the invention, it is explained that the maximum value of the widths of the non-concave portions (i.e., the convex portions 512 and the side portions 514), which is approximately 93 μm, is larger than the average opening width Eave of the pores 550*a* of the contact region of the toner-supplying roller 550, which is approximately 40 μm, or alternatively, the maximum value of the heights of the non-concave portions that is measured from the concave portion 515, which is approximately 8 μm, is larger than the average opening depth of the pores 550*a*. However, the scope of the invention is not limited to such an exemplary configuration. For example, the maximum value of the widths of the non-concave portions may be smaller than the average opening width Eave of the pores 550*a* of the contact region of the toner-supplying roller 550; and in addition thereto, the maximum value of the heights of the non-concave portions that is measured from the concave portion 515 may be smaller than the average opening depth of the pores 550*a*. Although it is possible to adopt such a modified configuration, it is more preferable that the maximum value of the widths of the non-concave portions should be larger than the average opening width Eave of the pores 550*a* of the contact region of the toner-supplying roller 550, or alternatively, the maximum value of the heights of the non-concave portions that is measured from the concave portion 515 should be larger than the average opening depth of the pores 550*a* as described in the foregoing exemplary embodiments of the invention because the foregoing configuration according to exemplary embodiments of the invention facilitates that at least one layer of toner T remains carried in the concave portion 515 immediately after the completion of development as explained below. On the condition that the maximum value of the widths of the non-concave portions (i.e., the convex portions 512 and the side portions 514) is larger than the average opening width Eave of the pores 550*a* of the contact region of the toner-supplying roller 550, or alternatively, on the condition that the maximum value of the heights of the non-concave portions that is measured from the concave portion 515 is larger than the average opening depth of the pores 550*a*, the pore 550*a* does not completely cover the non-concave portion, except for exceptional ones. Accordingly, when the contact region of the toner-supplying roller 550 contacts the development roller 510, each wall region 550*b* of the toner-supplying roller 550 formed between the pores 550*a* thereof adjacent to each other does not get into the non-convex portion 513 deeply so as to become in contact with the concave portion 515 of the development roller 510. For this reason, it is possible to significantly reduce the possibility of the undesirable removal of the lowest-layer toner T that is in contact with the concave portion 515 thereof (i.e., one layer or more of the toner T). Then, the remaining toner T of one layer or more, which includes, at least, the lowest-layer one that is in contact with the concave portion 515 thereof, continues to be carried in the concave portion 515 thereof. As a result thereof, the remaining toner T is further electrified. By this means, it becomes harder for the remaining toner T of one layer or more to move to the photosensitive member 20 at the time of development. Consequently, even immediately after that the concave portion 515 has passed through the development position, the lowest-layer toner T that is in contact with the concave portion 515 thereof is most likely to remain carried therein.

In the foregoing description of exemplary embodiments of the invention, it is explained that the moving speed of the surface of the development roller 510 measured at the time of the rotation thereof is greater than that of the photosensitive member 20 measured at the time of the rotation thereof. However, the scope of the invention is not limited to such an exemplary configuration. For example, the moving speed of the surface of the development roller 510 measured at the time of the rotation thereof may be lesser (i.e., slower) than that of the photosensitive member 20 measured at the time of the rotation thereof. Although it is possible to adopt such a modified configuration, it is more preferable that the moving speed of the surface of the development roller 510 measured at the time of the rotation thereof should be greater than that of the photosensitive member 20 measured at the time of the rotation thereof as described in the foregoing exemplary embodiments of the invention because the foregoing configuration according to exemplary embodiments of the invention makes it possible to avoid any shortage (i.e., insufficiency) in the amount of toner T that is used for developing a latent image as explained below. When development is performed in such a manner that at least one layer of toner T remains carried in the concave portion 515 immediately after the completion thereof, not all but some of the toner T carried in the non-convex portion 513, excluding the above-mentioned at least one layer thereof, moves to the photosensitive member 20. Therefore, there is an adverse possibility that the amount of toner T that is used for developing a latent image is insufficient. In this respect, on the condition that the moving speed of the surface of the development roller 510 measured at the time of the rotation thereof is greater than that of the photosensitive member 20 measured at the time of the rotation thereof, the development of a latent image that has a certain image length measured in the circumferential direction on the surface of the photosensitive member 20 is performed by means of toner T that is carried at a region on the circumferential surface of the development roller 510, where the circumferential region of the development roller 510 has a greater length than the above-mentioned certain image length of the latent image. By this means, it is possible to prevent any deficiency in the amount of toner T that is actually used for development even though at least one layer of the toner T that is in contact with the concave portion 515 remains carried thereon without being used for the development after the completion thereof. Configuration of Image Formation System Next, with reference to the accompanying drawing (FIG. 22), a non-limiting example of the configuration of an "image formation system" according to the invention is explained below.

Figure 22:
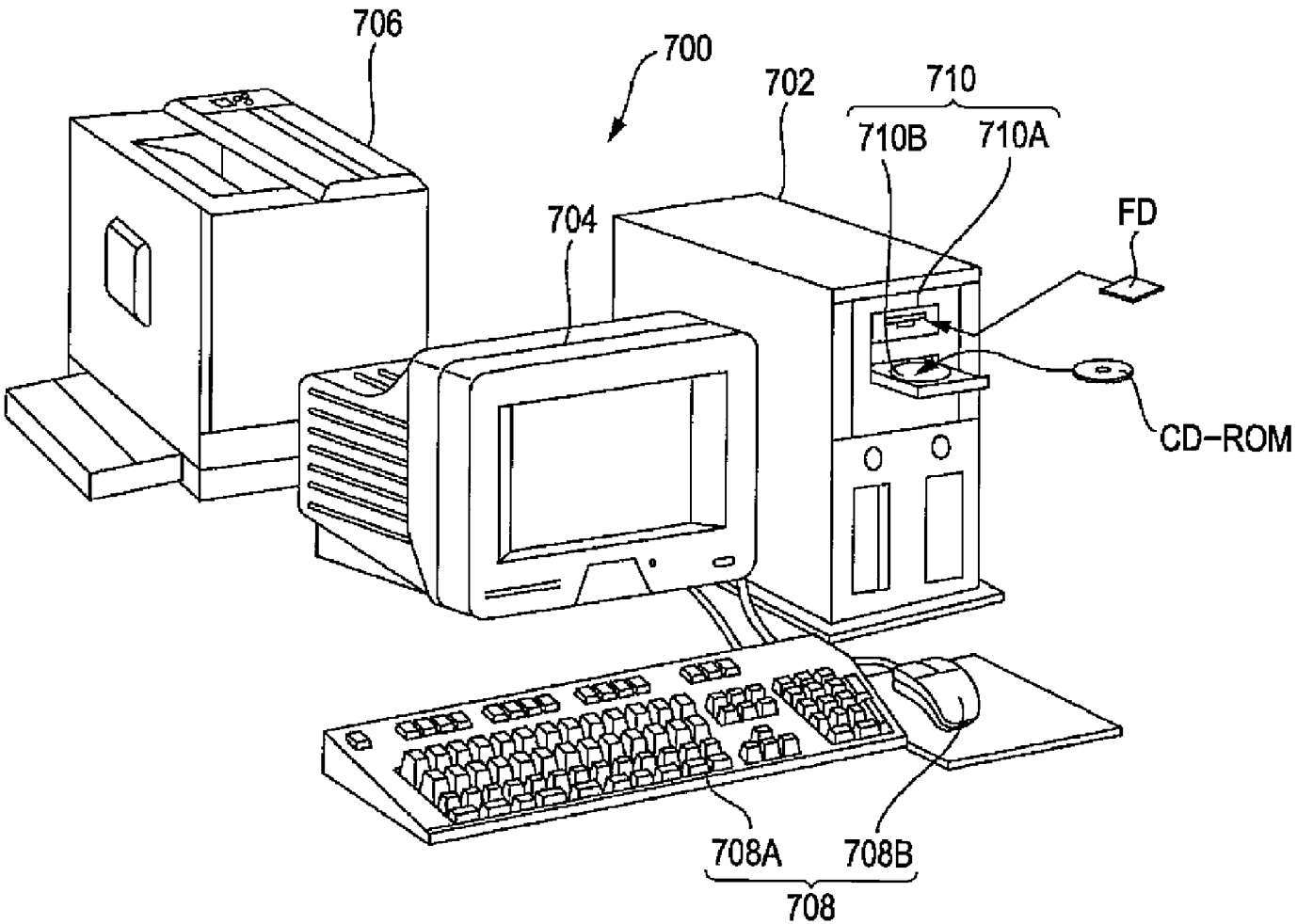
FIG. 22 is a perspective view that schematically illustrates the general appearance of an image formation system according to an exemplary embodiment of the invention.

FIG. 22 is a perspective view that schematically illustrates the general appearance of an image formation system according to an exemplary embodiment of the invention. An image formation system 700 according to the present embodiment of the invention is made up of, though not necessarily limited thereto, a computer 702, a display apparatus 704, a printer 706, an input device 708, and a reading device 710. In the configuration of the image formation system 700 according to the present embodiment of the invention, the computer 702 is housed in a mini-tower case. However, the configuration of the "image formation system" according to the invention is not limited to such an example. A few popular examples of the display apparatus 704 include a CRT (Cathode Ray Tube) display device, a plasma display device, and an LCD (Liquid Crystal Display) device. However, the configuration of the "image formation system" according to the invention is not limited to such an example. The above-explained laser beam printer 10 is used as the printer 706. In the configuration of the image formation system 700 according to the present embodiment of the invention, the input device 708 is made up of a keyboard 708A and a mouse 708B. However, the configuration of the "image formation system" according to the invention is not limited to such an example. In the configuration of the image formation system 700 according to the present embodiment of the invention, the reading device 710 is made up of an FD (Flexible Disk) drive unit 710A and a CD-ROM drive unit 710B. However, the configuration of the "image formation system" according to the invention is not limited to such an example. For example, the reading device 710 may be embodied as an MO (Magneto-Optical) disk drive unit and/or a DVD (Digital Versatile Disc) drive unit, though not limited thereto.

Figure 23:
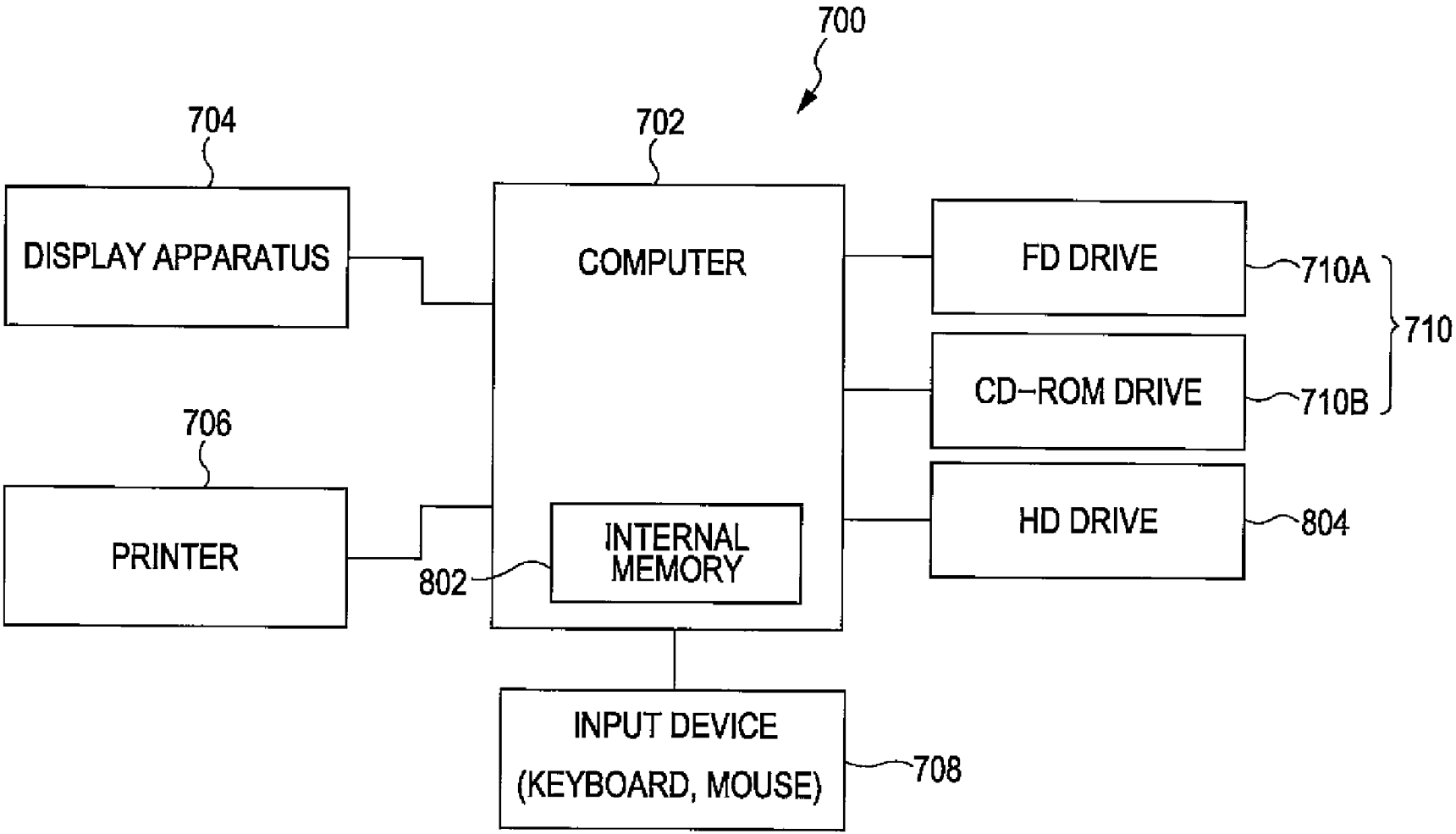
FIG. 23 is a block diagram that schematically illustrates an example of the configuration of the image formation system according to an exemplary embodiment of the invention (illustrated in FIG. 22).

FIG. 23 is a block diagram that schematically illustrates an example of the configuration of the image formation system 700 according to the present embodiment of the invention (illustrated in FIG. 22). An internal memory 802 that includes but not limited to a RAM and an external memory that includes but not limited to an HD (Hard Disk) drive unit 804 are provided inside the aforementioned case of the computer 702.

In the configuration of the image formation system 700 according to the present embodiment of the invention, it is explained and illustrated that the printer 706 is electrically connected to the computer 702, the display apparatus 704, the input device 708, and the reading device 710. However, the configuration of the "image formation system" according to the invention is not limited to such an example. As a non-limiting modification example thereof, the image formation system 700 according to the present embodiment of the invention ("image formation system" according to the invention) may be made up of the computer 702 and the printer 706 only. Or, as another non-limiting modification example thereof, any one or more of the display apparatus 704, the input device 708, and the reading device 710 may be omitted from the above-described configuration of the image formation system 700 according to the present embodiment of the invention.

As still another non-limiting modification example thereof, the printer 706 may have a part of the functions/configurations of the computer 702, the display apparatus 704, the input device 708, and the reading device 710. As a non-limiting specific example thereof, the printer 706 may have an image processing unit that performs image processing, a display unit that performs various kinds of display, and a storage medium attachment/detachment unit to/from which a storage medium in which the data of images that were photographed by a digital camera or the like is stored can be attached/detached.

The image formation system according to the invention that has the above-described configuration offers enhanced performance in comparison with that of conventional image formation systems.

The entire disclosure of Japanese Patent Application No. 2007-144064, filed May 30, 2007 is expressly incorporated by reference herein.

What is claimed is:

1. An image formation apparatus comprising:

an image carrier that carries a latent image;

a toner carrier that has, on a surface of the toner carrier, a concave portion arrayed in a regular pattern so as to carry toner, and develops the latent image that is carried on the image carrier by means of the toner carried in the concave portion;

a voltage application section that applies a development voltage to the toner carrier for the purpose of the development of the latent image; and a removing member that has a contact region made of a porous foam material, the contact region of the removing member contacting the surface of the toner carrier so as to remove the toner from the surface of the toner carrier after the development of the latent image carried on the image carrier, wherein the toner carrier has, on the surface thereof, a plurality of non-concave portions that are arrayed in a regular pattern, each of the plurality of non-concave portions having a convex portion and further having side portions that go down from the convex portion to the concave portion, the concave portion surrounding each of the plurality of non-concave portions; and the maximum value of the widths of the non-concave portions is larger than the average opening width of the pores of the contact region of the removing member, or alternatively, the maximum value of the heights of the non-concave portions that is measured from the concave portion is larger than the average opening depth of the pores, wherein, immediately after that the toner carrier has developed the latent image, which is carried on the image carrier, by means of the toner carried in the concave portion in response to the application of the development bias to the toner carrier by the voltage application section, at least one layer of the toner remains carried in the concave portion, and the concave portion is formed as the bottom of two different spiral-pattern groove regions one of which is formed to have an angle of gradient viewed with respect to the circumferential direction of the toner carrier that differs from another angle of gradient viewed with respect to the circumferential direction of the toner carrier of the other thereof; and these two different spiral-pattern groove regions intersect with each other, thereby forming a grid pattern.

2. The image formation apparatus according to claim 1, further comprising a layer-thickness controlling member that contacts the surface of the toner carrier so as to control the layer thickness of the toner that is carried on the surface of the toner carrier, wherein the depth of the concave portion is smaller than the volume mean particle diameter of the toner multiplied by three.

3. The image formation apparatus according to claim 1, wherein the moving speed of the surface of the toner carrier measured at the time of the rotation thereof is greater than that of the image carrier measured at the time of the rotation thereof.

4. An image formation apparatus comprising:

an image carrier that carries a latent image;

a toner carrier that has, on a surface of the toner carrier, a concave portion arrayed in a regular pattern so as to carry toner, and develops the latent image that is carried on the image carrier by means of the toner carried in the concave portion;

a voltage application section that applies a development voltage to the toner carrier for the purpose of the development of the latent image; and a removing member that has a contact region made of a porous foam material, the contact region of the removing member contacting the surface of the toner carrier so as to remove the toner from the surface of the toner carrier after the development of the latent image carried on the image carrier, wherein the toner carrier has, on the surface thereof, a plurality of non-concave portions that are arrayed in a regular pattern, each of the plurality of non-concave portions having a convex portion and further having side portions that go down from the convex portion to the concave portion, the concave portion surrounding each of the plurality of non-concave portions; and the maximum value of the distance between one convex portion and another convex portion adjacent thereto among the plurality of convex portions is smaller than the average distance between one pore of the contact region and another pore thereof adjacent thereto, wherein immediately after that the toner carrier has developed the latent image, which is carried on the image carrier, by means of the toner carried in the concave portion in response to the application of the development bias to the toner carrier by the voltage application section, at least one layer of the toner remains carried in the concave portion, and the concave portion is formed as the bottom of two different spiral-pattern groove regions one of which is formed to have an angle of gradient viewed with respect to the circumferential direction of the toner carrier that differs from another angle of gradient viewed with respect to the circumferential direction of the toner carrier of the other thereof; and these two different spiral-pattern groove regions intersect with each other, thereby forming a grid pattern.

5. An image formation system comprising:

a computer; and an image formation apparatus that can be connected to the computer, the image formation apparatus of the image formation system including:

an image carrier that carries a latent image;

a toner carrier that has, on a surface of the toner carrier, a concave portion arrayed in a regular pattern so as to carry toner, and develops the latent image that is carried on the image carrier by means of the toner carried in the concave portion;

a voltage application section that applies a development voltage to the toner carrier for the purpose of the development of the latent image; and a removing member that has a contact region made of a porous foam material, the contact region of the removing member contacting the surface of the toner carrier so as to remove the toner from the surface of the toner carrier after the development of the latent image carried on the image carrier, wherein the toner carrier has, on the surface thereof, a plurality of non-concave portions that are arrayed in a regular pattern, each of the plurality of non-concave portions having a convex portion and further having side portions that go down from the convex portion to the concave portion, the concave portion surrounding each of the plurality of non-concave portions; and the maximum value of the widths of the non-concave portions is larger than the average opening width of the pores of the contact region of the removing member, or alternatively, the maximum value of the heights of the non-concave portions that is measured from the concave portion is larger than the average opening depth of the pores, wherein, immediately after that the toner carrier has developed the latent image, which is carried on the image carrier, by means of the toner carried in the concave portion in response to the application of the development bias to the toner carrier by the voltage application section, at least one layer of the toner remains carried in the concave portion, and the concave portion is formed as the bottom of two different spiral-pattern groove regions one of which is formed to have an angle of gradient viewed with respect to the circumferential direction of the toner carrier that differs from another angle of gradient viewed with respect to the circumferential direction of the toner carrier of the other thereof; and these two different spiral-pattern groove regions intersect with each other, thereby forming a grid pattern.

* * * * *